US005399471A

United States Patent [19]

Murai

[11] Patent Number: 5,399,471

[45] Date of Patent: Mar. 21, 1995

[54] SILVER HALIDE COLOR PHOTOGRAPHIC LIGHT-SENSITIVE MATERIAL

[75] Inventor: Ashita Murai, Ashigara, Japan

[73] Assignee: Fuji Photo Film Co., Ltd., Kanagawa, Japan

[21] Appl. No.: 59,587

[22] Filed: May 12, 1993

[30] Foreign Application Priority Data

May 13, 1992 [JP] Japan ..... 4-146973

[51] Int. Cl.[6] ..... G03C 7/32; G03C 1/02

[52] U.S. Cl. ..... 430/544; 430/567

[58] Field of Search ..... 430/544, 567

[56] References Cited

U.S. PATENT DOCUMENTS 4,806,461 2/1989 Ikeda et al. ..... 430/567
5,043,258 8/1991 Ihama et al. ..... 430/567
5,068,173 11/1991 Takehara et al. ..... 430/567

*Primary Examiner*—Richard L. Schilling
*Attorney, Agent, or Firm*—Birch, Stewart, Kolasch & Birch

[57] ABSTRACT

A silver halide color photographic light-sensitive material comprising at least one light-sensitive silver halide emulsion layer on a support. The silver halide emulsion layer contains tabular grains having an aspect ratio of 3 or more and 10 or more dislocation lines per grain, in an amount of 30% or more of a total projected area of all grains in the layer. At least 30 mole % of all couplers contained in the emulsion layer is occupied by a DIR coupler which releases a diffusing development inhibitor or a precursor thereof upon reaction with an oxidized form of a developing agent, or cleaves to form another compound upon reaction with an oxidized form of a developing agent, which cleaved compound in turn reacts with another molecule of oxidized form of a developing agent to release a development inhibitor.

14 Claims, No Drawings

SILVER HALIDE COLOR PHOTOGRAPHIC LIGHT-SENSITIVE MATERIAL

BACKGROUND OF THE INVENTION

1. Field of the Invention

The present invention relates to a silver halide color photographic light-sensitive material, and more specifically, such material having an improved color reproducibility, high sensitivity, high contrast, improved graininess, and improved sharpness.

2. Description of the Related Art

In the field of silver halide color photographic light-sensitive materials, it is conventionally known to utilize the interlayer inhibition effect so as to improve the color reproducibility. In the case of color negative materials, color generation of a red-sensitive layer upon a white exposure can be inhibited more than that upon a red exposure by imparting a development inhibition effect from a green-sensitive layer to a red-sensitive layer. In the case of color negative papers, the gradation is balanced such that gray is reproduced on a color print when exposed by white light. Consequently, the above-mentioned interlayer effect achieves, when subjected to a red exposure, a cyan color having a density higher than the case of gray exposure, and therefore it is possible to reproduce a red color of a higher saturation degree, with inhibited cyan color generation. Similarly, the development inhibition effect from the red-sensitive layer to the green-sensitive layer reproduce a green color having a high saturation degree.

There are several methods for enhancing an interlayer effect. One of them is a technique such as disclosed in JP-A-50-2537, wherein a so-called DIR compound is added to an interlayer effect-imparting layer. The DIR compound is a coupler which releases a development inhibitor when reacting with an oxidized product of a developing agent in a paraphenylenediamine-based color developing solution. Another one is a technique which uses iodide ions released from silver halides during development. More specifically, in this technique, the content of silver iodide of an interlayer effect-imparting layer is increased, and that of a layer which receives such an effect is decreased in advance. Another well-known technique is an automatic masking method in which use is made of a colored coupler.

In particular, regarding the method in which a DIR compound is added to an interlayer effect-imparting layer, it is known that the development inhibitor released from the DIR compound not only achieves the interlayer effect, but also causes a horizontal Eberhard effect so as to enhance the image sharpness since the development inhibitor diffuses also in the direction perpendicular to a light beam made incident.

As disclosed in European Patent 101,621, or JP-A-59-131934, the horizontal Eberhard effect is prominent particularly in the case where the diffusibility of the development inhibitor or a precursor thereof is high, and the effect is advantageous for improvement of, not only color reproducibility, but also sharpness.

With the above-described means, the color reproducibility and sharpness of the color photographic light-sensitive material have been significantly improved; however the amount of the DIR compound contained in the interlayer effect-imparting layer must be inevitably increased so as to enhance the interlayer effect, creating the drawback of significantly inhibiting development of silver halide grains contained in that layer.

More specifically, the silver halide grains contained in an interlayer effect-imparting layer containing a large amount of the DIR compound entail significantly low sensitivity and contrast due to the development inhibitor released from the layer itself during development. If, in order to compensate the lowered performances, the size of the silver halide grains, or the number of the silver halide grains in the interlayer effect-imparting layer is increased, the graininess is degraded, or the sharpness of the under layer is deteriorated.

Thus, despite the demand for further improvement of the color reproducibility, the overall image quality is still not satisfactory, due to the above-described drawbacks. Consequently, there has been demand for means to overcome these drawbacks.

Recently, there have been a progress and improvement in graininess and sharpness achieved by silver halide grains themselves. For example, JP-A-58-113926, JP-A-58-113927, JP-A-58-113928, JP-A-58-113930, and JP-A-58-113934 each disclose a technique of using tabular silver halide grains for the purpose of improving the correlation between sensitivity and graininess, or sharpness.

Further, JP-A-63-220238, and JP-A-1-102547, for example, each disclose a technique for improving a variety of photographic characteristics by introducing dislocations, which are intentionally controlled, to the tabular silver halide grains.

Regarding the tabular silver halide grains, much research has been conducted for improving the graininess and sharpness; however, improvement of the color reproducibility has not been discussed in the research.

SUMMARY OF THE INVENTION

An object of the invention is to provide a silver halide color photographic light-sensitive material having an improved color reproducibility, high sensitivity, high contrast, improved graininess, and improved sharpness, by providing means for preventing degradation in the sensitivity and contrast of the interlayer effect-imparting layer containing a large amount of DIR coupler.

The above object of the present invention is achieved according to the present invention by a silver halide color photographic light-sensitive material comprising at least one light-sensitive silver halide emulsion layer on a support, wherein at least one light-sensitive silver halide emulsion layer contains tabular grains having an aspect ratio of 3 or more and 10 or more dislocation lines per grain, in an amount of 30% or more of a total projected area of all grains in the layer, and at least 30 mole % of all couplers contained in the layer is occupied by a DIR coupler which releases a diffusing development inhibitor or a precursor thereof upon reaction with an oxidized form of a developing agent, or which cleaves to form another compound upon reaction with an oxidized form of a developing agent, which cleaved compound in turn reacts with another molecule of oxidized form of a developing agent to release a development inhibitor.

As described above, it has been separately known that the color reproducibility could be improved by use of an interlayer effect-imparting layer containing a large amount of DIR coupler, and that the graininess and sharpness can be improved by use of tabular silver halide grains. However, it was an unexpected effect that a high quality silver halide photographic light-sensitive material having an improved color reproducibility can be obtained according to the invention by an interlayer effect-imparting layer described above and tabular silver halide grains having an aspect ratio of 3 or more, and each having 10 or more dislocation lines, with the drawbacks of an interlayer effect-imparting layer being overcome.

DETAILED DESCRIPTION OF THE PREFERRED EMBODIMENTS

The present invention will now be described in detail.

The silver halide grains used in the present invention are tabular silver halide grains having an aspect ratio of 3 or more, and each having 10 or more dislocation lines.

The term "tabular silver halide grain" (to be called as "tabular grain" hereinafter) is a general term of grains having one twin plane, or two or more twin planes arranged in parallel. The twin plane is defined as a (111) plane in the case where ions at all the lattice points on both sides of the (111) plane are arranged in a mirror image relationship. The tabular grain, when viewed from top, has a triangular shape, a hexagonal shape, or a round-off shape thereof, and the triangular grain, the hexagonal grain, or the round-off grain has outer surfaces of the respective shape arranged in parallel with each other.

The aspect ratio of a tabular grain used in the invention is defined as the value obtained by dividing a grain diameter by a thickness, regarding a tabular grain having a diameter of 0.1 μm or more.

The grain diameter is defined as the diameter of a circle having the equivalent area to the projected area of the outer parallel surfaces of a grain. The projected area of a grain can be obtained by measuring the area of a grain on an electron microscope, followed by correction based on the magnification. The thickness of a grain can be obtained easily in the following manner. A metal is vapor-deposited on a grain from a diagonal direction along with a latex sphere used as reference, and the length of the shadow is measured on an electron microscope. The thickness of the grain is calculated out with reference to the length of the shadow of the latex sphere.

The aspect ratio of a tabular grain used in the present invention is 3 or more, preferably 4 to 15, and more preferably, 5 to 8.

The diameter and thickness of a tabular grain can be set at desired values as long as the condition of the aspect ratio being 3 or more is satisfied; however the grain diameter is preferably 0.3 to 5.0 μm, more preferably, 0.4 to 3.0 μm, and the thickness is preferably 0.05 to 1.0 μm, more preferably 0.05 to 0.3 μm.

In some cases, a more advantageous result can be obtained by use of monodisperse tabular grains. The structure of monodisperse tabular grains, and a manufacture method thereof are disclosed in, for example, JP-A-63-151618. In short, the monodisperse tabular grains are those in which tabular silver halide grains having a hexagonal shape, with a ratio of the length of the longest side to that of the shortest side being 2 or less, and having two surfaces arranged in parallel with each other as outer surfaces, occupies 70% or more of the total projected area of all the grains. Further, the hexagonal tabular silver halide grains have such a monodispersibility that the variation coefficient of the grain size distribution of the hexagonal tabular silver halide grains is 25% or less. (The variation coefficient is the value obtained by dividing a standard deviation of the grain size represented by the equivalent-circle diameter of the projected area, by an average grain size.)

The grain size of the tabular grains used in the invention is preferably 0.3 μm to 3 μm in terms of equivalent-sphere diameter. The equivalent-sphere diameter is the value of the diameter of a sphere having the same volume as the volume of a silver halide grain, and can be measured by, for example, a Coulter Counter method (see "The Theory of the Photographic Process", McMilan Co., 4th ed., p-101).

Further, the tabular grains used in the present invention each contain dislocation lines. The dislocation lines of a grain can be observed by a direct method using a transmission type electron microscope at low temperature, disclosed in, for example, J. F. Hamilton, Phot. Sci. Eng., 11, 57 (1967), T. Shiozawa, J. Soc. Phot. Sci. Japan, 35, 213 (1972), and JP-A-63-220238. More specifically, silver halide grains are carefully taken out from an emulsion so as not to apply a pressure enough to create dislocation lines in each grain, and placed on a mesh used for electron microscope observation. The samples (silver halide grains) are cooled so as to avoid damage (print out, etc.) caused by electron beams, and observed by the transmission method. Here, the thicker the grains, the less the transmissibility of the electron beams, and therefore a clearer observation can be achieved by use of a high voltage type electron microscope (200 kV or higher against a grain having a thickness of 0.25 μm). In observation of dislocation lines by use of an electron microscope, since the crystal lattice is distorted in shape at a section where dislocation lines are present, electron beams are scattered, forming dark lines on a print. (Note that negative films are used in a regular electron microscope procedure, and on a negative film, white lines appear.) However, if electron beams are not made incident on a silver halide grain to be observed, at an appropriate angle, dislocation lines may not be observed despite that they are present in the grain. In this case, the angle of the sample holder of the microscope is varied gradually so as to change the incident angle of the electron beams with respect to the grain. In this manner, the presence or absence, the position, and the number of dislocation lines can be obtained by taking several photos of a grain at the same field of view while changing the angle of the sample holder of the electron microscope.

The number of dislocation lines is 10 or more per grain, preferably an average of 20 or more per grain. Where dislocation lines are densely present, or crossed with each other, the number of dislocation lines per grain cannot be exactly counted often. However, even in this case, the dislocation lines can be counted in units of tens such as 10, 20, 30 and so on, those of which can be clearly distinguished from those having only a few dislocation. The average number of dislocation lines per grain is found by dividing the number of lines counted of 100 or more grains by the number of the grains inspected.

As mentioned above, the tabular grains used in the invention have an average of 10 or more dislocation lines per grain, and it is preferred that grains having 10 or more dislocation lines occupy 50% or more of all the grains in number, more preferably 70% or more.

The dislocation lines can be formed, for example, in a region close to the periphery of the tabular grain. In this case, the dislocation lines are present substantially perpendicular to the periphery, each starting from a point at an X% position along a length of an imaginary line starting from the center of the tabular grain to a side (periphery) thereof, and reaching the periphery. The value of X is preferably 10 or more, but less than 100, more preferably, 30 or more, but less than 99, and most preferably, 50 or more, but less than 98. The figure formed by connecting the starting point of each line is substantially similar to the shape of the grain, but not exactly similar, and may be distorted. There are no such dislocation lines present in the center region of the grain. Crystallographically, the dislocation lines are oriented in approximately (211) direction, but often they are arranged in a zigzag manner, or crossed with each other.

Further, a tabular grain may contain dislocation lines substantially uniformly over the entire peripheral region, or in some localized areas around the periphery. In the case of a hexagonal tabular silver halide grain, the locations of dislocation lines may be limited to a region close to each of the six corners, or to a region close to one of the six corners. Further, they may be limited to a region close to each of the sides, not the six corners.

The dislocation lines may be formed over regions including the center of the two main parallel planes of a tabular grain. In the case where the dislocation lines are formed over the entire region of the main planes, the dislocation lines may be directed in approximately (211) direction with respect to the direction perpendicular to the main planes, or in (110) direction, or even in random directions. The length of each dislocation line is also random, and therefore a dislocation line may be observed as a short line appeared on the main planes, or as a long line with one end reaching a side (periphery). Each dislocation line may be a straight line or bent in a zigzag manner. In many cases, dislocation lines cross with each other.

As described above, the locations of the dislocation lines may be limited to some regions around the periphery or the main planes, or the dislocation lines may be formed as a combination thereof, more specifically, the lines may be present in the peripheral portion and on the main planes at the same time.

Dislocation lines can be formed in the peripheral portion of a tabular grain by providing a silver iodide-rich layer in the interior of the grain. The formation of the silver iodide-rich layer includes the case where silver iodide-rich regions are discontinuously formed. More specifically, formation of dislocation lines is conducted in the following manner. After substrate grains are prepared, a silver iodide-rich layer is formed, and then the outer surface of the layer is covered by a layer having a silver halide content lower than that of the silver iodide-rich layer. The silver iodide content of the substrate tabular grain is lower than that of the silver iodide-rich layer, and is preferably 0 to 20 mole %, more preferably 0 to 15 mole %.

The silver iodide-rich layer in the interior of a grain is a silver halide solid solution containing silver iodide. Preferable examples of the silver halide are silver iodide, silver iodobromide, and silver chloroiodobromide, with silver iodide and silver iodobromide (silver iodide content of 10 to 40 mole %) being more preferable. In order to make the silver iodide-rich layer (to be called as inner silver iodide-rich layer) in the interior of a grain present selectively either on a side or corner of a substrate grain, the conditions for forming substrate grains and inner silver iodide-rich layer are controlled. The important factors for forming the substrate grains are pAg (logarithm of the reciprocal of silver ion concentration), the presence or absence of a silver halide solvent, the type and amount thereof, and the temperature. By setting pAg during growth of the substrate grains at 8.5 or less, more preferably, 8 or less, the inner silver iodide-rich layer can be made present selectively close to a corner of the substrate base grain. On the other hand, by setting pAg during growth of the substrate grains at 8.5 or higher, preferably 9 or higher, the inner silver iodide-rich layer can be made present on a side of the substrate grain. The threshold value for pAg varies up or down in accordance with the temperature, the presence or absence of a silver halide solvent, the type and amount thereof. For example, a thiocyanate is used as the silver halide solvent, the threshold of pAg goes up. A pAg value of a particular importance during growth is the pAg value at the final stage of the growth of the substrate grain. In the case where pAg during the growth does not meet the above value, the selective position of the inner silver iodide-rich layer can be controlled by adjusting pAg to the above value and ripening the substrate grain, after growth thereof. Here, ammonia, an amine compound, and a thiocyanate salt are useful silver halide solvents. Formation of an inner silver iodide-rich layer can be performed by a conversion method. The conversion method includes a method of adding halogen ions during formation of the grain. The added halogen ions are those which form with silver ions salts having a lower solubility than salts halogen ions which constitute, at the time of the addition, a grain or the surface portion thereof. In the invention, it is preferable that a certain amount (in relation to a halogen composition) or more of the halogen ions having a lower solubility be added per surface area of a grain at the time of addition. For example, a certain amount or more of KI is added during formation of grains per surface area of the AgBr grains at the time of addition. More specifically, $8.2\times10^{-5}$ mole or more of an iodide salt is preferably added per surface area of the grain.

A more preferable method of forming a silver iodide-rich layer involves simultaneous addition of an aqueous silver salt solution and an aqueous halide salt solution containing an iodide salt.

For example, at the same time as addition of an aqueous KI solution, an aqueous $AgNO_3$ solution is added by means of double jet. When the KI and $AgNO_3$ solutions are so added, the addition starting time and the ending time of one solution may not be synchronous respectively with those of the other. The mole ratio of the $AgNO_3$ solution added to the KI solution is preferably 0.1 or more, more preferably 0.5 or more, with 1 or more being most preferable. The total mole amount of the $AgNO_3$ solution added may be stoichemically excess in silver ions with respect to the halogen ions in the reaction system plus the added iodide ions. It is preferable that the pAg value during addition of the halide solution containing iodide ions and addition of the silver salt solution by double jet decreases along with time in the course of the double jet addition. The pAg value before the start of addition is preferably in the range between 6.5 and 13, more preferably, between 7.0 and 11. The pAg value at the end of addition is most preferably in the range between 6.5 and 10.0.

When the above-described method is practiced, it is preferable that the solubility of the silver halide in the system be as low as possible. Therefore, the temperature of the system during the formation of the silver iodide-rich layer is preferably in the range between 30° C. and 70° C., more preferably between 30° C. and 50° C.

It is most preferable that formation of an inner silver iodide-rich layer be performed by adding fine grain silver iodide, fine grain silver iodobromide, fine grain silver chloroiodide, or fine grain silver chloroiodebromide. Of these, use of fine grain silver iodide is particularly preferable. The fine grains usually have a grain size of 0.01 μm to 0.1 μm, but fine grains having a grain size of less than 0.01 μm, or of more than 0.1 μm may be also used. JP-A-1-183417, JP-A-2-44335, JP-A-1-183644, JP-A-1-183645, WO 89/06830 and WO/06831 disclose examples of the method of preparing fine grain silver halide. The inner silver iodide-rich layer can be formed by adding fine grain silver halide, followed by ripening. In order to dissolve the fine grains by ripening, the above-mentioned silver halide solvent can be used. The added fine grains do not have to be immediately all dissolved to disappear, but should be completely dissolved to disappear until the formation of the final grains is finished.

The silver iodide content of the outer layer covering the inner silver iodide-rich layer is lower than that of the silver iodide-rich layer, and is preferably 0 to 30 mole %, more preferably, 0 to 20 mole %, with 0 to 10 mole % being most preferable. The inner silver iodide-rich layer is preferably located within an area in the hexagon, or the respective shape, obtained by projecting the grain, which area contains silver in an amount of 5 mole % or more but less than 100 mole % of the total amount of silver in the grain when measured from the center of the projected shape, more preferably 20 mole % or more but less than 95 mole %, with 50 mole % or more but less than 90 mole %. The silver content of silver halide constituting the inner silver iodide-rich layer is 50 mole % or less of the total silver content of the entire grain, and more preferably 20 mole % or less. These values in connection with the silver iodide-rich layer are formulation values used in the silver halide emulsion preparation, and are not values obtained by measuring the halogen composition of the final grain by means of various analyzing methods. It should be noted that the inner silver iodide-rich layer in the final grain is likely to disappear during a recrystallizing process or the like. All of the above description is related to the manufacturing method thereof.

In the final grain, dislocation lines can be easily observed by the above-described method; however in many cases, an inner silver iodide-rich layer introduced to form the dislocation lines cannot be observed as a distinct layer. For example, the peripheral portion of a tabular grain is all observed as a silver iodide-rich layer in some cases. The halogen composition can be specified by means of combination of X-ray diffraction, EPMA (also called as XMA) method (silver halide composition is detected by scanning a silver halide grain with electron beam), ESCA (also called as XPS) method (photo-electron emitted from the grain surface upon irradiation of X-ray is dispersed), etc.

The temperature and pAg during the formation of the outer layer, which covers the inner silver iodide-rich layer, can be set at any desired values at the time of formation of the outer layer. However, a preferable temperature is in the range between 30° C. and 80° C., with the range between 35° C. and 70° C. being most preferable, whereas a preferable pAg value is in the range between 6.5 and 11.5. Further, in some cases, it is preferable to use the above-mentioned silver halide solvent, with thiocyanate salt being the most preferred silver halide solvent.

In order to form dislocation lines on the main surfaces of a tabular grain, first, substrate grains are prepared, and silver halochloride is deposited on the main surfaces of the substrate grain. Then, a silver bromide-rich or silver iodide-rich layer is formed through conversion of the silver halochloride, and a shell layer is provided so as to cover the layer. Preferable examples of silver halochloride are silver chloride, and silver chlorobromide or bromochloroiodide containing 10 mole % or more, preferably 60 mole % or more of silver halide, and silver chloride. The silver halochloride can be deposited on the main plane of the substrate grain by adding an aqueous silver nitrate solution and an aqueous solution of an appropriate alkali metal salt (e.g., potassium chloride) separately or at the same time, or by adding an emulsion made of the silver halochloride, followed by ripening. The deposition of silver halochloride can be performed at any desired pAg value, with 5.0 or more but 9.5 or less being most preferable. With this method, tabular grains are grown mainly in the thickness direction. The amount of the silver halochloride layer is 1 to 80 mole %, more preferably 2 to 60 mole % with respect to the amount of the substrate grain in terms of silver. By conversion of the silver halochloride layer using a solution of a halide which can form a silver salt having a solubility lower than that of the silver halochloride, dislocation lines can be formed on the main planes of a tabular grain. For example, the silver halochloride layer is converted by an aqueous KI solution, and then a shell is grown so as to obtain the final grain. In the halogen conversion of the silver halochloride layer, not all of the silver halochloride is necessary to be converted to a silver salt having a solubility lower than that of silver halochloride, but preferably 5% or more, more preferably 10% or more, most preferably 20% or more of the silver halochloride is converted to the silver salt having a lower solubility. Dislocation lines can be formed at a desired localized region in the main surface by controlling the halogen structure of substrate grains on which the silver halochloride layer is formed. For example, when an inner silver iodide-rich structure in a substrate tabular grain is displaced in the lateral direction of the substrate grain, dislocation lines can be formed in the region excluding the center portion of the main plane, that is, only in the peripheral region thereof. Alternatively, when an outer silver iodide-rich structure in a substrate tabular grain is displaced in the lateral direction of the substrate grain, dislocation lines can be formed in the region excluding the peripheral portion of the main plane, that is, only in the center region thereof. Further, by use of a site director for epitaxial growth of silver halochloride, such as an iodide, silver halochloride can be deposited only in a limited region of the area, and dislocation lines can be formed only in that region. During deposition of silver halochloride, the temperature is preferably in a range of 30° to 70° C., with a range of 30° to 50° C. being more preferable. Although the conversion can be performed after deposition of silver halochloride, and then a shell can be grown, it is also possible to carry out halogen conversion while growing a shell after deposition of silver halochloride.

The total amount of silver of the silver halochloride layers to be formed on both sides of the two parallel main planes and in a direction perpendicular to the main planes is preferably within a range of 5 mole % to less than 100 mole %, more preferably 20 mole % to less than 95 mole %, most preferably 50 mole % to less than 90 mole %, of the total silver amount of the grain.

The silver iodide content of the shell is preferably 0 to 30 mole %, with 0 to 20 mole % being more preferable. The temperature and pAg value during formation of the shell can be set as desired, but a preferable temperature is in a range of 30° to 80° C., with 35° to 70° C. being more preferable, and a preferable pAg value is in a range of 6.5 to 11.5. In some cases, it is preferable to use the above-mentioned silver halide solvent, and the most preferable silver halide solvent is a thiocyanate salt. In the final grain, the halogen-converted inner silver halochloride layer may not be detected by the aforementioned analyzing method for halogen composition under some conditions such as a degree of halogen-conversion. In contrast, dislocation lines can be clearly detected.

The method of forming dislocation lines in a desired region on the main plane of a tabular grain, and the method of forming them in a desired region on the peripheral portion of a tabular grain may be combined with each other appropriately when forming dislocation lines.

The tabular substrate grain used in the present invention can be easily prepared by methods disclosed in, for example, "Photography Theory and Practice" by Cleve, page 131, (1930); "Photographic Science and Engineering" by Gutoff, Vol. 14, pages 248–257 (1970); U.S. Pat. Nos. 4,434,226, 4,414,310, 4,433,048, and 4,439,520, and British Patent 2,112,157.

Silver halide emulsions which can be used together with the above-mentioned emulsions of the invention include silver bromide, silver iodobromide, silver bromochloroiodide, and silver chlorobromide. A preferable silver halide is silver iodobromide or bromochloroiodide containing 30 mole % or less of silver iodide.

In the silver halide emulsion which can be combinedly used in the invention, the crystal structure of a silver halide grain may be uniform, may have different halogen compositions in the interior and the surface thereof, or may be a layered structure. These emulsion grains are disclosed in, for example, British Patent 1,027,146, and U.S. Pat. Nos. 3,505,068, 4,444,877 and 4,668,614. Alternatively, a silver halide having a different composition may be joined by an epitaxial junction or a compound except for a silver halide, such as silver rhodanide or zinc oxide, may be joined.

The tabular grains used in the invention, and the silver halide grains which can be combinedly used in the invention may be treated such as to round off the grains as disclosed in, e.g., EP-0096727B2, or EP-0064412B1, or to modify the surface thereof as disclosed in DE-2306447C2 or JP-A-60-221320.

The tabular grains used in the invention, and the silver halide grains which can be combinedly used in the invention is preferably of a surface latent image type, but as disclosed in JP-A-59-133542, an interior latent image type emulsion may be also used by selecting appropriate conditions for the developer solution or the development. Further, a shallow interior latent image type emulsion with a thin shell, may be used in accordance with purpose.

In order to promote ripening, a silver halide solvent is useful. For example, it is known that an excessive amount of halogen ions is made present in a reaction vessel to promote ripening. Therefore, it is obvious that ripening can be promoted by introducing a halide salt solution in the reaction vessel. Other ripening agents can be also used. The ripening agent may be added in advance to a dispersion medium in the reaction vessel in its entire amount before adding silver and halide salts, or may be introduced in the vessel along with one or more halide salts, silver salts, or deflocculants. In another example, the ripening agent may be introduced independently at the time of addition of a halide salt and a silver salt.

Examples of the ripening agent other than halogen ions are ammonia, amine compounds, and thiocyanate salts such as an alkali metal thiocyanate salt, and particularly sodium and potassium thiocyanate salts, and an ammonium thiocyanate salt.

The tabular grains used in the invention should preferably be of the type in which the silver iodide amount is uniform between grains. A judgment on whether or not the silver iodide amount between grains is uniform can be made by means of the above-mentioned EPMA method (Electron-Probe Micro Analyzer method).

In this method, emulsion grains are well dispersed such that the grains are not brought into contact with each other to prepare a sample, and electron beams are irradiated on the sample. Thus, the elemental analysis of a fine very section can be conducted through an X-ray diffraction method using electron ray excitation.

More specifically, the intensity of each of the X-rays radiated from each grain and characteristic to silver and iodine, is measured so as to determine the halogen composition of each grain.

It is preferable that the relative standard deviation of the silver iodide amount distribution between grains is 50% or less, with 35% or less being more preferable, and 20% or less being most preferable.

In preparing the tabular grains used in the invention, a cadmium salt, a zinc salt, a thallium salt, an iridium salt or a complex salt thereof, a rhodium salt or a complex salt thereof, or an iron salt or an iron complex salt may be co-present during formation or physical ripening of the silver halide grains. Most perferred is an iridium salt.

The tabular grains used in the invention may have been subjected to internal reduction sensitization during formation of grains or physical ripening, as disclosed in Moisar et al. "Journal of Photographic Science" Vol. 25, 1977, pages 19–27. The reduction sensitization can be carried out by either a method wherein a reduction sensitizer is added to a silver halide emulsion, a so-called silver ripening method wherein growth or ripening is carried out in a low pAg environment of pAg 1–7, or a so-called high pH ripening method wherein growth or ripening is carried out in a high pH environment of pH 8–11. Examples of the reduction sensitizer used for carrying out the reduction sensitization are a stannous salt, an amine or a polyamine, a hydradine derivative, a formamidine sulfinic acid, a silane compound, and a borane compound.

Usually, the tabular silver halide grains of the invention have been subjected to chemical sensitization.

The chemical sensitization is carried out after formation of the silver halide emulsion, and the formed emulsion may be washed with water by a general method before the sensitization. Washing emulsion with water may be carried out by the method disclosed in Research Disclosure No. 308119 (Dec. 1989), Chapter II.

The chemical sensitization can be carried out by use of active gelatin as disclosed in T. H. James et al., "The Theory of the Photographic Process", 4th ed., pp. 67–76, Macmillan, 1977; or by use of sulfur, selenium, tellurium, gold, platinum, palladium, iridium or combinations of these sensitizers at pAg of 5–10, pH 5–8, and a temperature of 30° to 80° C. as disclosed in Research Disclosure Vol. 120, April 1974, 12008, Research Disclosure Vol. 34, June 1975, 13452, U.S. Pat. Nos. 2,642,361, 3,297,446, 3,772,031, 3,857,711, 3,901,714, 4,266,018, and 3,904,415, and British Patent 1,315,755. Most preferably, the chemical sensitization is carried out in the presence of a gold compound and a thiocyanate compound, by use of a combination of a sulfur-containing compound such as hypo, a thiourea compound, or a rhodanine compound disclosed in U.S. Pat. Nos. 3,587,711, 4,266,018, and 4,054,457, and a selenium compound disclosed in, e.g., U.S. Pat. Nos. 3,297,446, 3,297,447, 3,408,196, 3,408,197, 3,442,653.

The chemical sensitization can be carried out in the presence of a chemical sensitization aid. Well-known compounds which can suppress fogging and increase the sensitivity during chemical sensitization, such as azaindene, azapyridazine, and azapyrimidine, are used as the chemical sensitization aid. Examples of a modifier of the chemical sensitization aid are disclosed in U.S. Pat. Nos. 2,131,038, 3,411,914, and 3,554,747, JP-A-58-126526, and "Photographic Emulsion Chemistry" by Dafin, pp. 138–143.

In addition to, or in place of, the chemical sensitization, reduction sensitization can be carried out by use of hydrogen, for example, as disclosed in U.S. Pat. Nos. 3,891,446 and 3,984,249. Alternatively, as disclosed in U.S. Pat. Nos. 2,518,698, 2,743,182, and 2,743,183, the reduction sensitization can be carried out by use of a reducing agent such as stannous chloride, thiourea dioxide, or polyamine, or by means of low pAg (e.g., less than 5) and/or high pH (e.g., more than 8) process.

It is preferable that the tabular silver halide emulsion of the invention is spectrally sensitized by a spectral sensitizing dye. Any spectral sensitizing dye which can be usually used for a silver halide photographic light-sensitive material may be used as the spectral sensitizing dye, with a cyanine dye, a merocyanine dye, and a composite merocyanine dye being more preferable. More specifically, the spectral sensitizing dyes represented by formula (I) and (II) set forth in JP-A-63-106745, pp. 23–42 are most preferable.

The spectral sensitizing dyes can be used singly or in combination, and combinations of sensitizing dyes are often used for the purpose of supersensitization.

The supersensitization method is disclosed in, for example, U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862, and 4,026,707, JP-B-43-4936, JP-B-53-12375, and JP-A-52-110618, JP-A-52-109925, and JP-A-2-127636.

Addition of the dye to an emulsion may be conducted at any stage of preparation of the emulsion, which is known to be useful. Most generally, the addition is carried out after completion of the chemical sensitization and before coating. However, the dye may be added at the same time as addition of the chemical sensitizer so as to perform the spectral sensitization and chemical sensitization at the same time as disclosed in U.S. Pat. Nos. 3,628,969, and 4,225,666, or may be added before the chemical sensitization as disclosed in, e.g., JP-A-58-113,928, JP-A-59-9658, JP-A-61-103149, and JP-A-61-133941. The spectral sensitization can be started by adding the dye before the completion of formation of silver halide grain precipitate. Further, as set forth in U.S. Pat. No. 4,225,666, these dyes can be added separately, that is, a part of the dyes is added prior to the chemical sensitization, and the rest can be added after the chemical sensitization. That is, addition of the dyes may be at any time during formation of the silver halide grains. Regarding the tabular silver halide emulsion of the invention, it is preferable that a spectral sensitization dye is added before chemical sensitization.

The amount of dye added may be $4\times10^{-6}$ to $1\times10^{-2}$ mole per mole of silver halide. In the case where the silver halide grain size (equivalent-sphere diameter) is 0.2 to 1.5 μm, the amount of about $5\times10^{-5}$ to $6\times10^{-3}$ mole per mole of silver halide is more effective.

A coupler of the present invention, which reacts with the oxidized form of a developing agent to release a diffusible development inhibitor or a precursor of a development inhibitor, will be described below. In addition, a coupler of the invention which cleaves to form another compound after reacting with the oxidized form of a developing agent, which cleaved compound in turn reacts with another molecule of the oxidized form of a developing agent to release a diffusible development inhibitor or a precursor thereof will also be described.

These couplers are preferably represented by Formulas (I), (II), or (III) below:

Formula (I) A-DI

Formula (II) A-$(TIME)_a$-DI

Formula (III) A-$(TIME)_i$-RED-DI where A represents a coupler moiety which undergoes a coupling reaction with the oxidized form of an aromatic primary amine developing agent to split off DI, $(TIME)_a$-DI, or $(TIME)_i$-RED-DI; TIME represents a timing group which cleaves DI or RED-DI after splitting off from A or TIME upon the coupling reaction; RED represents a group which reacts with the oxidized form of a developing agent after splitting off from A or TIME to cleave DI bonded to it; DI represents a development inhibitor; a represents 1 or 2; and i represents 0 or 1. If a represents 2, two TIMEs may be the same or different.

A coupler moiety represented by A will be described.

If A represents a yellow dye-forming coupler moiety, examples of the coupler moiety are a pivaloylacetanilide type coupler moiety, a benzoylacetanilide type coupler moiety, a malondiester type coupler moiety, a malondiamide type coupler moiety, a dibenzoylmethane type coupler moiety, a benzothiazolylacetamide type coupler moiety, a malonestermonoamide type coupler moiety, a benzoxazolylacetamide type coupler moiety, a benzoimidazolylacetamide type coupler moiety, and a cycloalkanoylacetamide type coupler moiety. A coupler moiety described in U.S. Pat. Nos. 5,021,332 or 5,021,330 or EP 421,221A can also be used.

If A represents a magenta dye-forming coupler moiety, examples of the coupler moiety are a 5-pyrazolone type coupler moiety, a pyrazolobenzimidazole type coupler moiety, a pyrazolotriazole type coupler moiety, a pyrazoloimidazole type coupler moiety, and a cyanoacetophenone type coupler moiety.

If A represents a cyan dye-forming coupler moiety, examples of the coupler moiety are phenol type and naphthol type coupler moieties. It is also possible to use a coupler moiety described in U.S. Pat. No. 4,746,602 or EP 249,453A.

A can be a coupler moiety which does not substantially form a dye. Examples of the coupler moiety of this type are indanone type and acetophenone type coupler moieties, and eluting coupler moieties described in EP 443,530A and 444,501A.

If A represents a coupler moiety in Formula (I), (II) or (III), preferable examples of A are coupler moieties represented by Formulas (Cp-1), (Cp-2), (Cp-3), (Cp-4), (Cp-5), (Cp-6), (Cp-7), (Cp-8), (Cp-9), and (Cp-10) below. These couplers are preferable because of their high coupling rates.

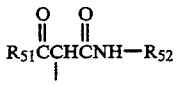

formula (Cp-1)

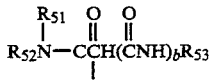

formula (Cp-2)

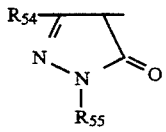

formula (Cp-3)

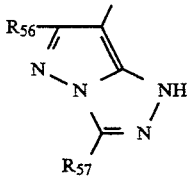

formula (Cp-4)

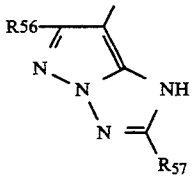

formula (Cp-5)

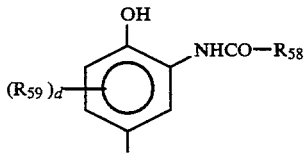

formula (Cp-6)

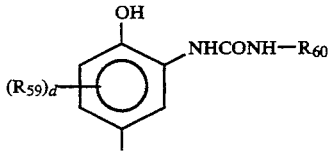

formula (Cp-7)

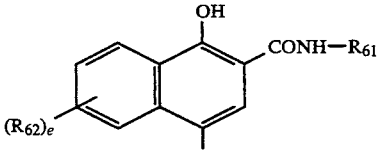

formula (Cp-8)

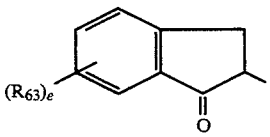

formula (Cp-9)

-continued

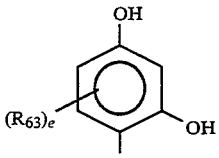

formula (Cp-10)

In the above formulas, the free bond deriving from the coupling position represents the bonding position of a coupling split-off group.

In the above formulas, if $R_{51}$, $R_{52}$, $R_{53}$, $R_{54}$, $R_{55}$, $R_{56}$, $R_{57}$, $R_{58}$, $R_{59}$, $R_{60}$, $R_{61}$, $R_{62}$, or $R_{63}$ includes a nondiffusing group, the group is so selected as to have a total number of carbon atoms of 8 to 40, preferably 10 to 30. Otherwise, the total number of carbon atoms is preferably 15 or less. In the case of a bis, telomer, or polymer type coupler, one of the above substituents represents a divalent group and connects the coupler units. In this case, the number of carbon atoms may fall outside the range defined above.

$R_{51}$ to $R_{63}$, b, d, and e will be described in detail below. In the following description, $R_{41}$ represents an alkyl group, an aryl group, or a heterocyclic group, $R_{42}$ represents an aryl group or a heterocyclic group, and each of $R_{43}$, $R_{44}$, and $R_{45}$ represents a hydrogen atom, an alkyl group, an aryl group, or a heterocyclic group. $R_{51}$ is of the same meaning as $R_{41}$. Each of $R_{52}$ and $R_{53}$ is of the same meaning as $R_{43}$. b represents 0 or 1. $R_{54}$ represents a group having the same meaning as $R_{41}$, an $R_{41}CO(R_{43})N$-group, an $R_{41}SO_2(R_{43})N$-group, an $R_{41}(R_{43})N$-group, an $R_{41}S$-group, an $R_{43}O$-group, or an $R_{45}(R_{43})NCON(R_{44})$-group.

$R_{55}$ represents a group having the same meaning as $R_{41}$. Each of $R_{56}$ and $R_{57}$ represents a group having the same meaning as $R_{43}$, an $R_{41}S$-group, an $R_{43}O$-group, an $R_{41}CO(R_{43})N$-group, or an $R_{41}SO_2(R_{43})N$-group. $R_{58}$ represents a group having the same meaning as $R_{41}$. $R_{59}$ represents a group having the same meaning as $R_{41}$, an $R_{41}CO(R_{43})N$-group, an $R_{41}OCO(R_{43})N$-group, an $R_{41}SO_2(R_{43})N$-group, an $R_{43}(R_{44})NCO(R_{45})N$-group, an $R_{41}O$-group, an $R_{41}S$-group, a halogen atom, or an $R_{41}(R_{43})N$-group. d represents 0 to 3. If d represents the plural number, a plurality of $R_{59}$'s represent the same substituent or different substituents. $R_{60}$ represents a group having the same meaning as $R_{41}$. $R_{61}$ represents a group having the same meaning as $R_{41}$. $R_{62}$ represents a group having the same meaning as $R_{41}$, an $R_{41}CONH$-group, an $R_{41}OCONH$-group, an $R_{41}SO_2NH$-group, an $R_{43}(R_{44})NCONH$-group, an $R_{43}(R_{44})NSO_2NH$-group, an $R_{43}O$-group, an $R_{41}S$-group, a halogen atom, or an $R_{41}NH$-group. $R_{63}$ represents a group having the same meaning as $R_{41}$, an $R_{43}CO(R_{44})N$-group, an $R_{43}(R_{44})NCO$-group, an $R_{41}SO_2(R_{43})N$-group, an $R_{41}(R_{43})NSO_2$-group, an $R_{41}SO_2$-group, an $R_{43}OCO$-group, an $R_{43}O—SO_2$-group, a halogen atom, a nitro group, a cyano group, or an $R_{43}CO$-group. e represents an integer from 0 to 4. If a plurality of $R_{62}$'s or $R_{63}$'s are present, they may be the same or different.

In the above description, the alkyl group is a saturated or unsaturated, chain or cyclic, straight-chain or branched, substituted or unsubstituted alkyl group having 1 to 32, preferably 1 to 22 carbon atoms. Representative examples of the alkyl group are methyl, cyclopropyl, isopropyl, n-butyl, t-butyl, i-butyl, t-amyl, n-hexyl, cyclohexyl, 2-ethylhexyl, n-octyl, 1,1,3,3-tetramethylbutyl, n-decyl, n-dodecyl, n-hexadecyl, and n-octadecyl.

The aryl group is a substituted or unsubstituted aryl group having 6 to 20 carbon atoms, preferably a substituted or unsubstituted phenyl group or a substituted or unsubstituted naphthyl group.

The heterocyclic group is a substituted or unsubstituted, preferably 3- to 8-membered, heterocyclic group having 1 to 20, preferably 1 to 7 carbon atoms and at least one heteroatom selected from a nitrogen atom, an oxygen atom and a sulfur atom. Representative examples of the heterocyclic group are 2-pyridyl, 2-benzoxazolyl, 2-imidazolyl, 2-benzimidazolyl, 1-indolyl, 1,3,4-thiadiazol-2-yl, 1,2,4-triazol-2-yl, and 1-indolynyl.

If the alkyl group, the aryl group, and the heterocyclic group described above have substituents, representative examples of the substituents are a halogen atom, an $R_{47}O$-group, an $R_{46}S$-group, an $R_{47}CO(R_{48})N$-group, an $R_{47}(R_{48})NCO$-group, an $R_{46}OCO(R_{47})N$-group, an $R_{46}SO_2(R_{47})N$-group, an $R_{47}(R_{48})NSO_2$-group, an $R_{46}SO_2$-group, an $R_{47}OCO$-group, an $R_{47}NCO(R_{48})N$-group, an $R_{47}CONHSO_2$-group, an $R_{47}NHCONHSO_2$-group, a group having the same meaning as $R_{46}$, an $R_{47}(R_{48})N$-group, an $R_{46}COO$-group, an $R_{47}OSO_2$-group, a cyano group, and a nitro group. $R_{46}$ represents an alkyl group, an aryl group, or a heterocyclic group, and each of $R_{47}$, $R_{48}$, and $R_{49}$ represents an alkyl group, an aryl group, a heterocyclic group, or a hydrogen atom. These alkyl, aryl, and heterocyclic groups have the same meanings as defined above.

Preferable ranges of $R_{51}$ to $R_{63}$, b, d, and e will be described below.

$R_{51}$ is preferably an alkyl group, an aryl group, or a heterocyclic group. Each of $R_{52}$ and $R_{55}$ is preferably an aryl group. Preferably, $R_{53}$ is an aryl group when b is 1, and is a heterocyclic group when b is 0. $R_{54}$ is preferably an $R_{41}CONH$-group or an $R_{41}(R_{43})N$-group. Each of $R_{56}$ and $R_{57}$ is preferably an alkyl group, an $R_{41}O$-group, or an $R_{41}S$-group.

$R_{58}$ is preferably an alkyl group or an aryl group. In Formula (Cp-6), $R_{59}$ is preferably a chlorine atom, an alkyl group, or an $R_{41}CONH$-group. d is preferably 1 or 2. $R_{60}$ is preferably an aryl group. In Formula (Cp-7), $R_{59}$ is preferably an $R_{41}CONH$-group. In Formula (Cp-7), d is preferably 1. $R_{61}$ is preferably an alkyl group or an aryl group. In Formula (Cp-8), e is preferably 0 or 1. $R_{62}$ is preferably an $R_{41}OCONH$-group, an $R_{41}CONH$-group, or an $R_{41}SO_2NH$-group, and the substitution position of any of these substituents is preferably the 5-position of the naphthol ring. In Formula (Cp-9), $R_{63}$ is preferably an $R_{41}CONH$-group, an $R_{41}SO_2NH$-group, an $R_{41}(R_{43})NSO_2$-group, an $R_{41}SO_2$-group, an $R_{41}(R_{43})NCO$-group, a nitro group, or a cyano group. In Formula (Cp-10), $R_{63}$ is preferably an $R_{43}NCO$-group, an $R_{43}OCO$-group, or an $R_{43}CO$-group.

A development inhibitor represented by DI will be described below.

Examples of a development inhibitor represented by DI are described in Research Disclosure Vol. 76, No. 17643 (December, 1978), U.S. Pat. Nos. 4,477,563; 5,021,332; 5,026,628; 3,227,554; 3,384,657; 3,615,506; 3,617,291; 3,733,201; 3,933,500; 3,958,993; 3,961,959; 4,149,886; 4,259,437; 4,095,984 and 4,782,012, British Patent 1,450,479, and U.S. Pat. No. 5,034,311. The development inhibitor is preferably a heterocyclic thio group, a heterocyclic seleno group, or a triazolyl group (a single-rign or fused-ring 1,2,3-triazolyl or 1,2,4-triazolyl), and most preferably tetrazolylthio, tetrazolylseleno, 1,3,4-oxadiazolylthio, 1,3,4-thiadiazolylthio, 1-(or 2-)benzotriazolyl, 1,2,4-triazol-1-(or 4-)yl, 1,2,3-triazol-1-yl, 2-benzothiazolylthio, 2-benzoxazolylthio, 2-benzimidazolylthio, or a derivative of any of them. Preferable development inhibitors are represented by Formulas DI-1 to DI-6 below:

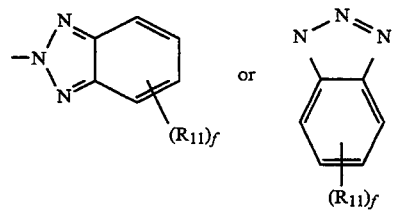

DI-1

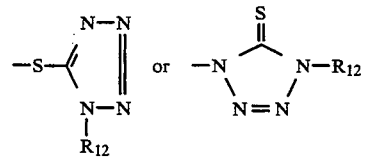

DI-2

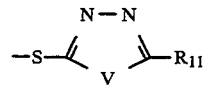

DI-3

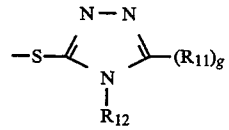

DI-4

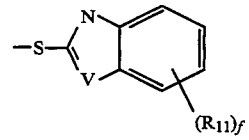

DI-5

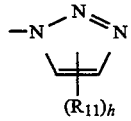

DI-6 where $R_{11}$ represents a halogen atom (e.g., a bromine atom or a chlorine atom), an alkoxycarbonyl group (having 2 to 20, preferably 2 to 10 carbon atoms; e.g., methoxycarbonyl or isoamyloxycarbonylmethoxy), an acylamino group (having 2 to 20, preferably 2 to 10 carbon atoms; e.g., hexanamide or benzamide), a carbamoyl group (having 1 to 20, preferably 1 to 10 carbon atoms; e.g., N-butylcarbamoyl, N,N-diethylcarbamoyl, or N-mesylcarbamoyl), a sulfamoyl group (having 1 to 20, preferably 1 to 10 carbon atoms; e.g., N-butylsulfamoyl), an alkoxy group (having 1 to 20, preferably 1 to 10 carbon atoms; e.g., methoxy or benzyloxy), an aryloxy group (having 6 to 20, preferably 6 to 10 carbon atoms; e.g., phenoxy, 4-methoxyphenoxy, or naphthoxy), an aryloxycarbonyl group (having 7 to 21, preferably 7 to 11 carbon atoms; e.g., phenoxycarbonyl), an alkoxycarbonylamino group (having 1 to 20, preferably 1 to 10 carbon atoms; e.g., ethoxycarbonylamino), a cyano group, a nitro group, an alkylthio group (having 1 to 20, preferably 1 to 10 carbon atoms; e.g., methylthio or hexylthio), a ureido group (having 1 to 20, preferably 1 to 10 carbon atoms; e.g., N-phenylureido), an aryl group (having 6 to 10 carbon atoms; e.g., phenyl, naphthyl, or 4-methoxyphenyl), a heterocyclic group (having 1 to 10 carbon atoms, which is a 3- to 12-membered, preferably 5- or 6-membered single-ring or fused-ring heterocyclic group containing at least one heteroatom selected from a nitrogen atom, an oxygen atom and a sulfur atom; e.g., 2-pyridyl, 1-pyrrolyl, morpholino, or indolyl), an alkyl group (having 1 to 20, preferably 1 to 10 carbon atoms, which is a straight-chain, branched, or cyclic, saturated or unsaturated alkyl group; e.g., methyl, ethyl, butoxycarbonylmethyl, 4-methoxybenzyl, or benzyl), an acyl group (having 1 to 20, preferably 2 to 10 carbon atoms; e.g., acetyl or benzoyl), an arylthio group (having 6 to 10, preferably 6 to 10 carbon atoms; e.g., phenylthio or naphthylthio), or an aryloxycarbonylamino group (having 7 to 11 carbon atoms; e.g., phenoxycarbonylamino). These substituents can further have substituents, examples of which are those enumerated above.

In the above formulas, $R_{12}$ represents an aryl group (having 6 to 10 carbon atoms; e.g., phenyl, naphthyl, 4-methoxyphenyl, or 3-methoxycarbonylphenyl), a heterocyclic group (having 1 to 10 carbon atoms, which is a 3- to 12-membered, preferably 5- or 6-membered single-ring or fused-ring heterocyclic group containing at least one heteroatom selected from a nitrogen atom, an oxygen atom and a sulfur atom; e.g., 2-pyridyl, 1-pyrrolyl, morpholino, or indolyl), or an alkyl group (having 1 to 20, preferably 1 to 10 carbon atoms, which is a straight-chain, branched, or cyclic, saturated or unsaturated alkyl group; e.g., methyl, ethyl, butoxycarbonylmethyl, 4-methoxybenzyl, or benzyl). V represents an oxygen atom or a sulfur atom. f represents 1 to 4, g represents 0 or 1, and h represents 1 or 2.

A group represented by TIME will be described below.

A group represented by TIME can be any linking group as long as it can cleave DI after cleaved from A during development. Examples of the group are a group described in U.S. Pat. Nos. 4,146,396, 4,652,516, or 4,698,297, which utilizes a cleavage reaction of hemiacetal; a timing group described in U.S. Pat. Nos. 4,248,962, 4,847,185, or 4,857,440, which causes a cleavage reaction by utilizing an intramolecular nucleophilic substitution reaction; a timing group described in U.S. Pat. Nos. 4,409,323 or 4,421,845, which causes a cleavage reaction by utilizing an electron transfer reaction; a group described in U.S. Pat. No. 4,546,073, which causes a cleavage reaction by utilizing a hydrolytic reaction of iminoketal; and a group described in West German Patent 2,626,317, which causes a cleavage reaction by utilizing a hydrolytic reaction of ester. TIME bonds with A at a heteroatom, preferably an oxygen atom, a sulfur atom or a nitrogen atom contained in it. Preferable examples of TIME are those represented by Formulas (T-1), (T-2), and (T-3) below:

Formula (T-1) $*\text{-W-}(X{=}Y)_j\text{-C}(R_{21})R_{22}\text{-}^{**}$

Formula (T-2) *-W-CO-**

Formula (T-3) *-W-LINK-E-** where mark * represents a position where TIME bonds with A in Formula (II), mark ** represents a position where TIME bonds with DI, or TIME (if a represents the plural number), W represents an oxygen atom, a sulfur atom, or $>N\text{-}R_{23}$, each of X and Y represents a methine group or a nitrogen atom, j represents 0, 1, or 2, and each of $R_{21}$, $R_{22}$, and $R_{23}$ represents a hydrogen atom or a substituent. Any two substituents selected from the substituents of a methine group represented by X and Y, and the substituents represented by $R_{21}$, $R_{22}$ and $R_{23}$ may or may not bond together to form a cyclic structure (e.g., a benzene ring or a pyrazole ring). In Formula (T-3), E represents an electrophilic group, and LINK represents a linking group which sterically links W to E so that they can undergo an intramolecular nucleophilic substitution reaction.

Specific examples of TIME represented by Formula (T-1) are as follows.

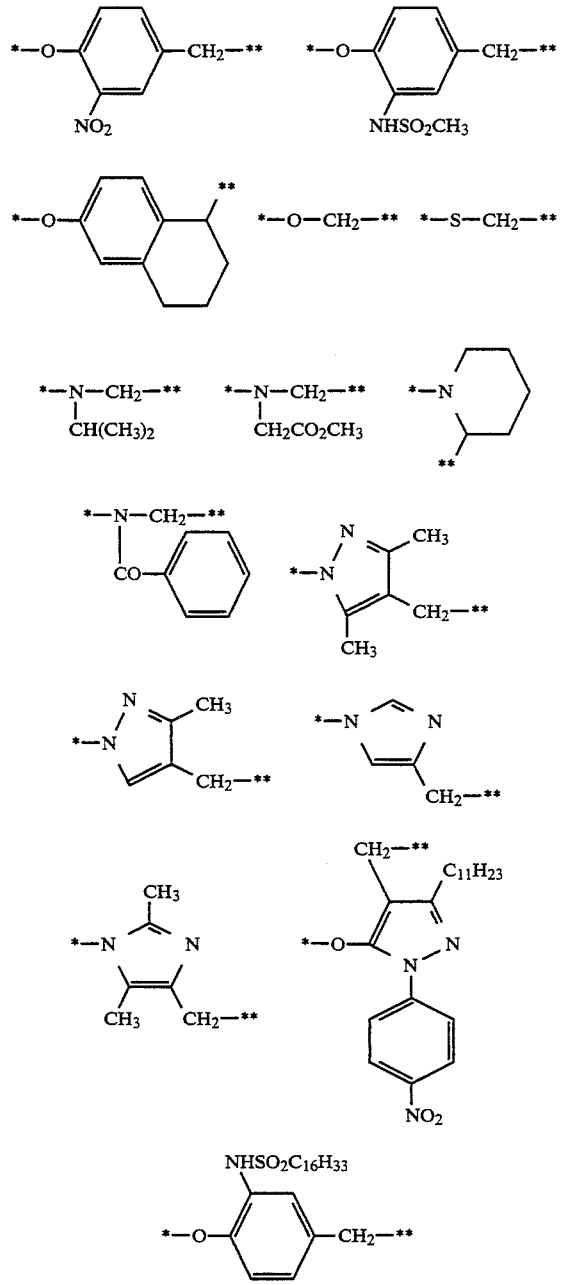

Specific examples of TIME represented by Formula (T-2) are as follows.

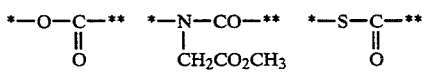

Specific examples of TIME represented by Formula (T-3 ) are as follows.

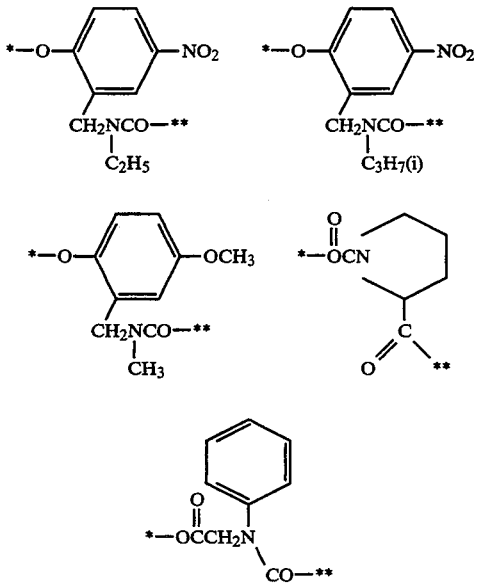

Specific examples of $(TIME)_a$ when a represents 2 or more in Formula (II) are as follows.

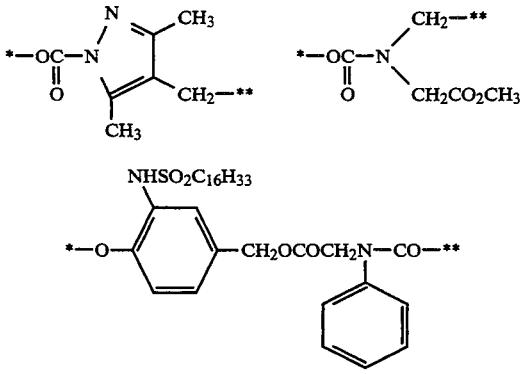

-continued

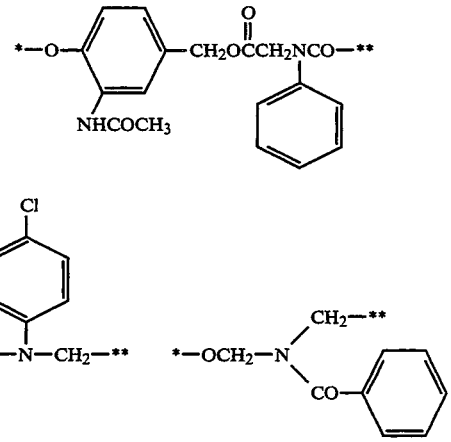

A group represented by RED in Formula (III) will be described below.

After cleaved from A or TIME, a compound represented by Formula (III) splits off RED-DI. This split-off group, RED-DI, can be cross-oxidized by an acidic substance, such as the oxidized form of a developing agent, present in development. RED-DI can be any compound as long as it cleaves DI when oxidized. Examples Of RED are hydroquinones, catechols, pyrogallols, 1,4-naphthohydroquinones, 1,2-naphthohydroquinones, sulfonamidophenols, hydrazides, and sulfonamidonaphthols. Specific examples of these groups are described in JP-A-61-230135, JP-A-62-251746, JP-A-61-278852, U.S. Pat. Nos. 3,364,022; 3,379,529; 4,618,571; 3,639,417; and 4,684,604, and J. Org. Chem., Vol. 29, page 588 (1964).

Of these compounds, preferable examples of RED are hydroquinones, 1,4-naphthohydroquinones, 2-(or 4-)sulfonamidophenols, pyrogallols, and hydrazides. Of these compounds, a redox group having a phenolic hydroxyl group combines with A at the oxygen atom of the phenol group.

Representative examples of the DIR coupler used in the present invention are presented below, but the present invention is not limited to these examples.

(D-1)

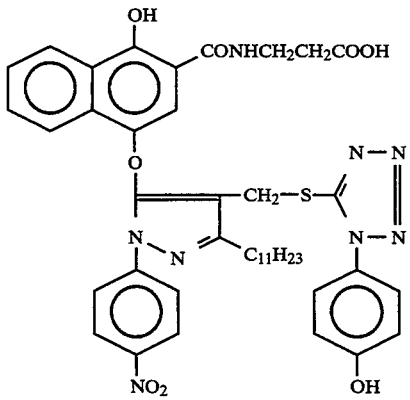

-continued
(D-2)
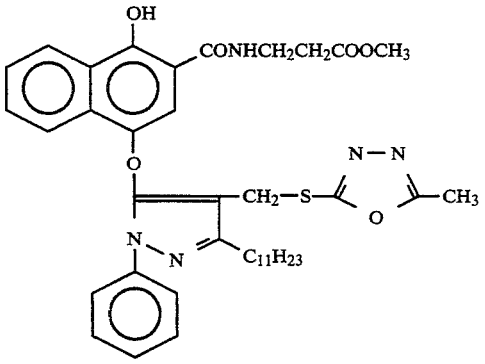
(D-3)
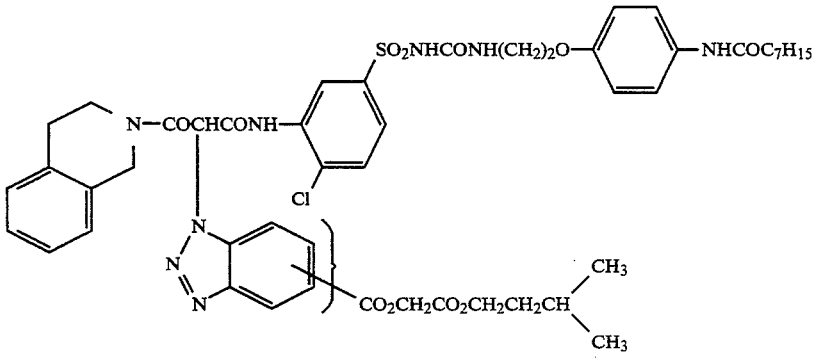
(D-4)
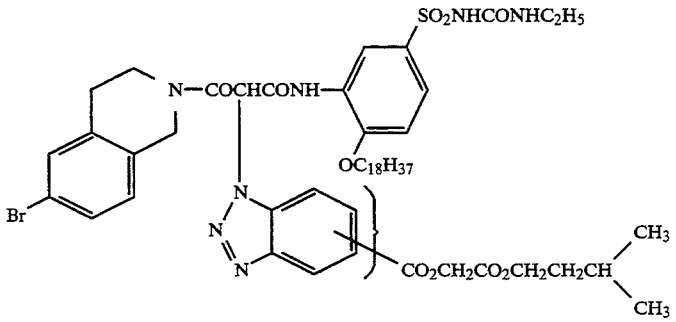
(D-5)
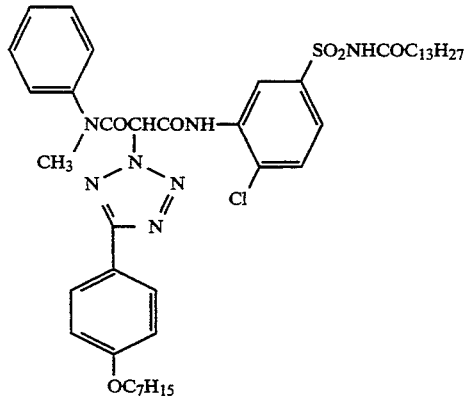

-continued
(D-6)
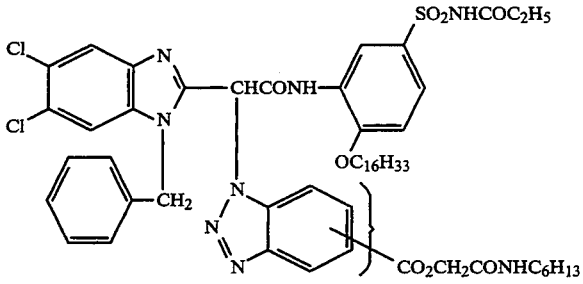
(D-7)
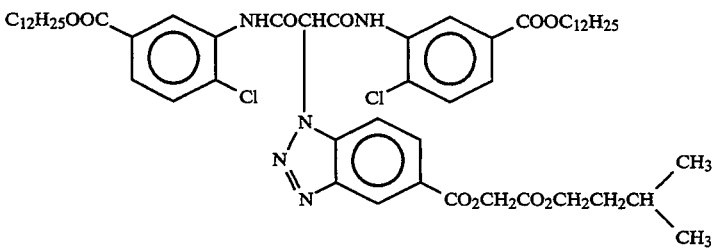
(D-8)
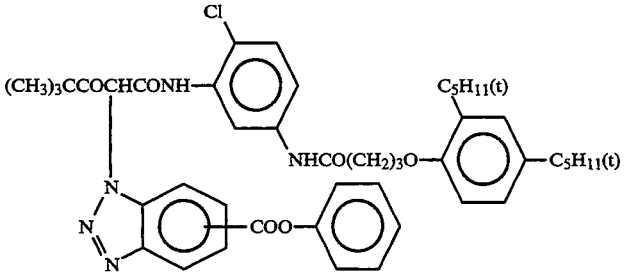
(D-9)
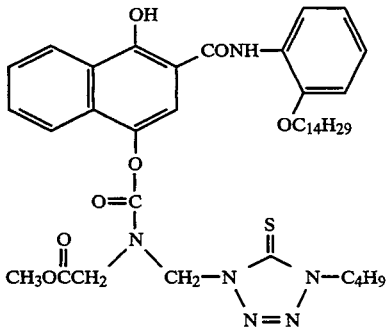
(D-10)
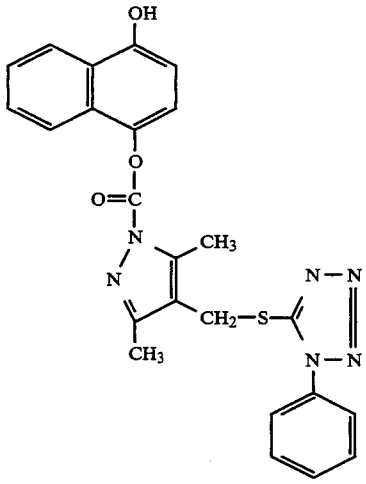

-continued
(D-11)
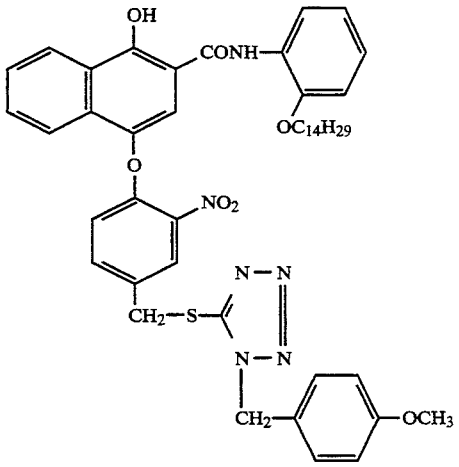
(D-12)
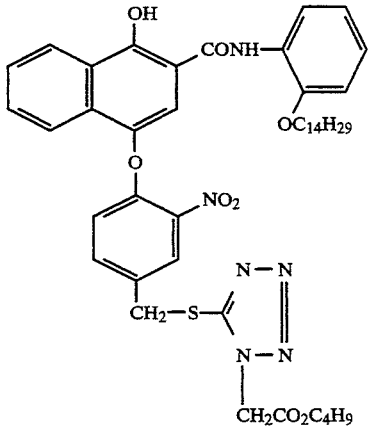
(D-13)
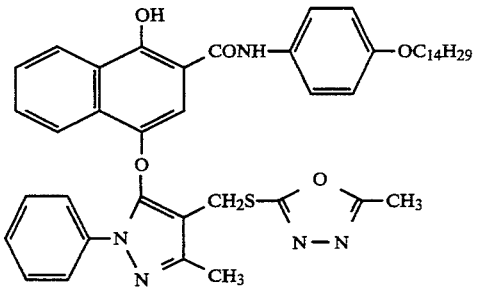
(D-14)
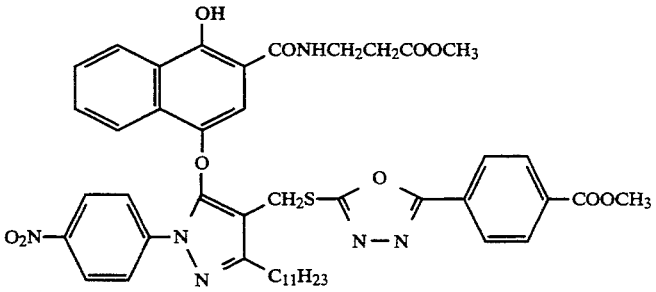

-continued
(D-15)
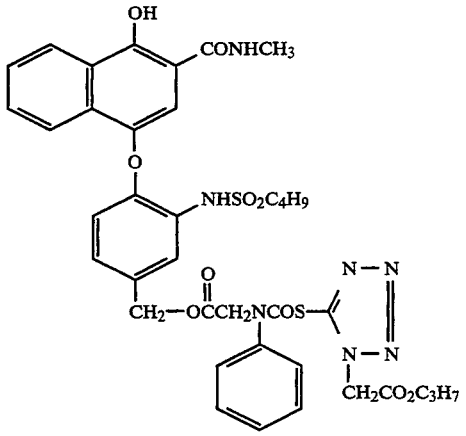
(D-16)
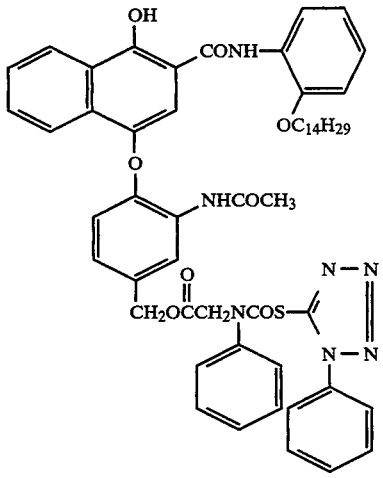
(D-17)
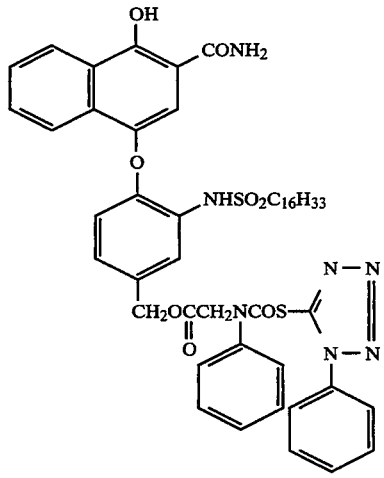

-continued
(D-18)
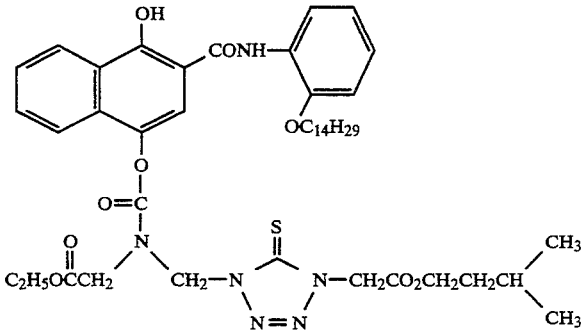
(D-19)
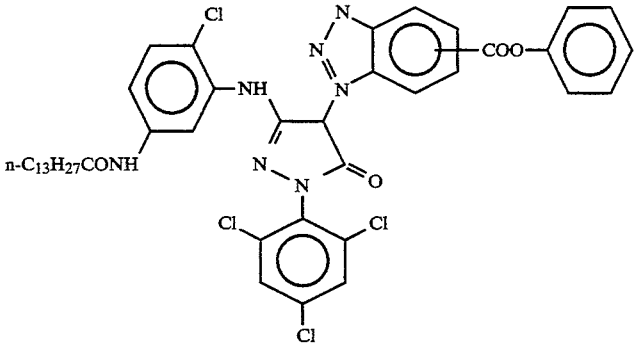
(D-20)
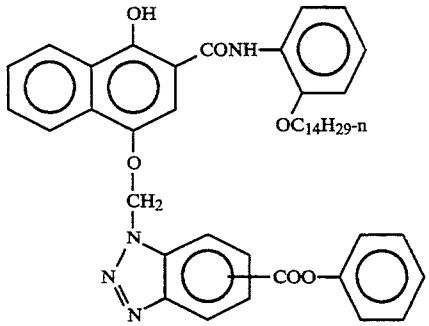
(D-21)
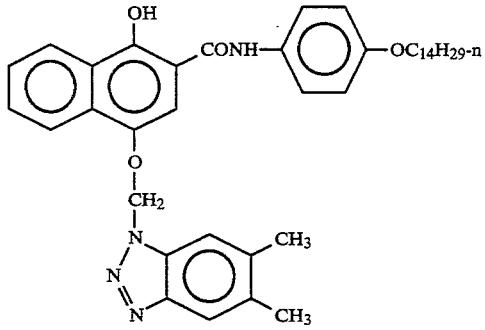
(D-22)
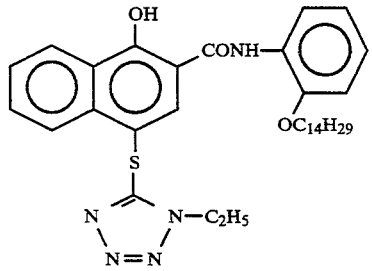

-continued
(D-23)
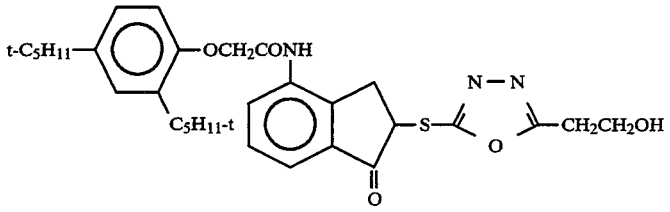
(D-24)
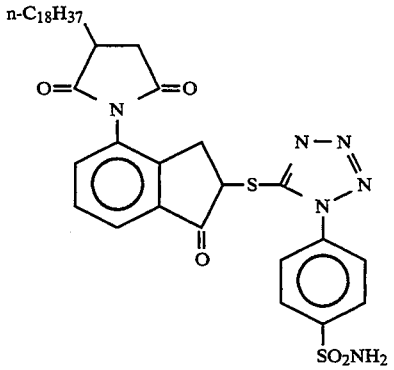
(D-25)
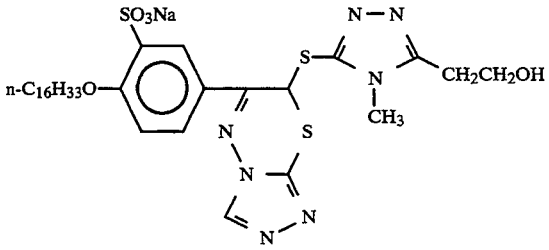
(D-26)
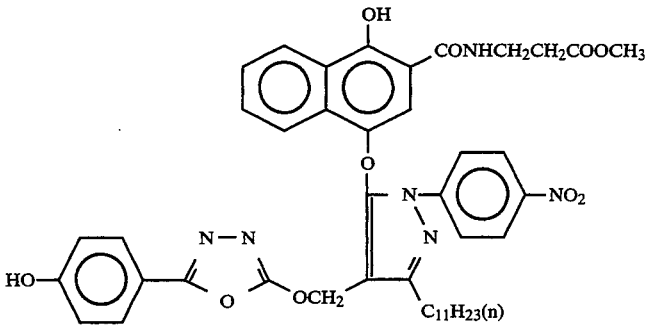
(D-27)
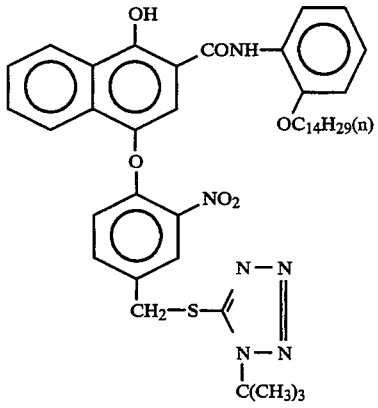

-continued
(D-28)
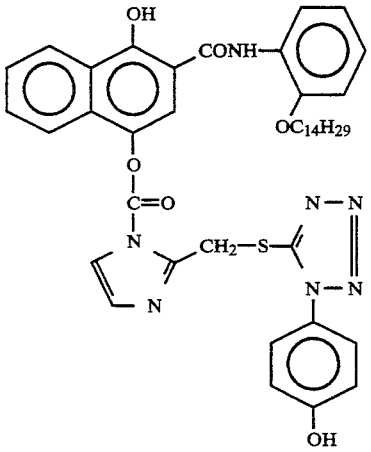
(D-29)
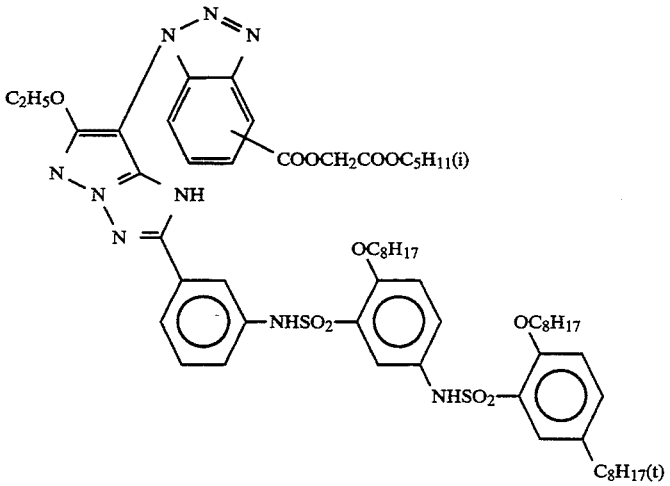
(D-30)
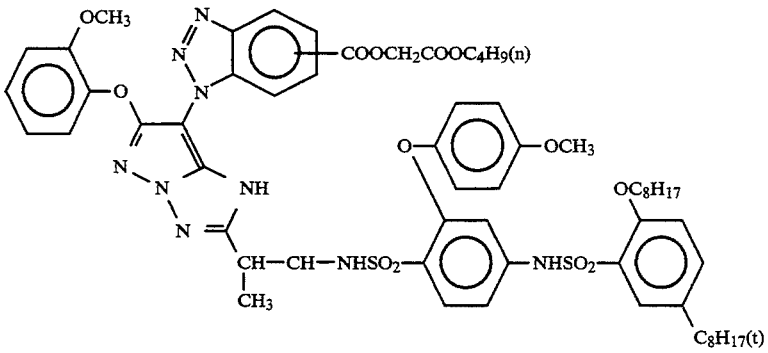
(D-31)
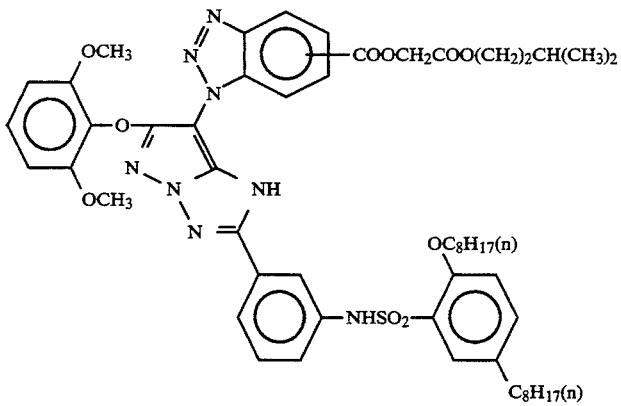

-continued
(D-32)
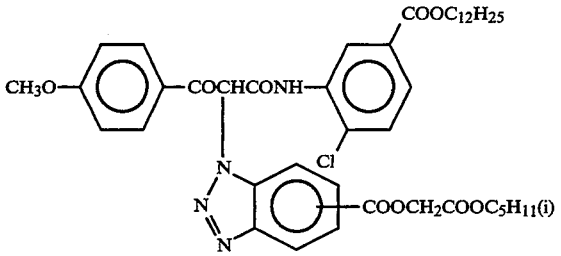
(D-33)
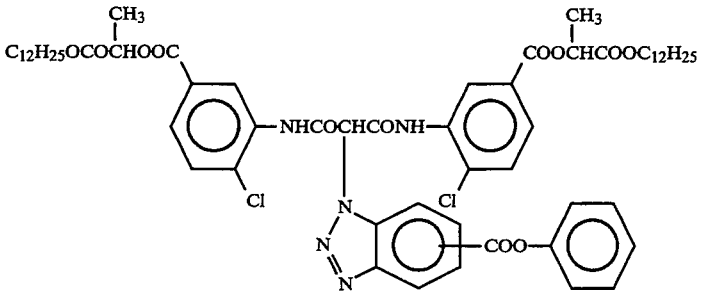
(D-34)
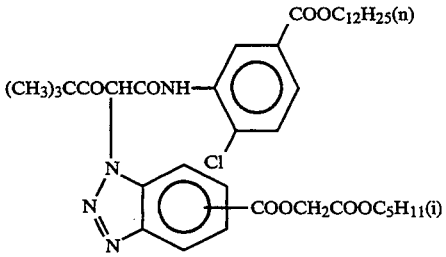
(D-35)
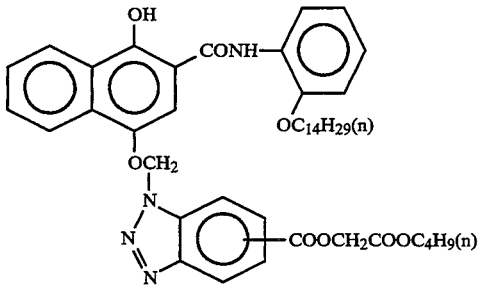
(D-36)
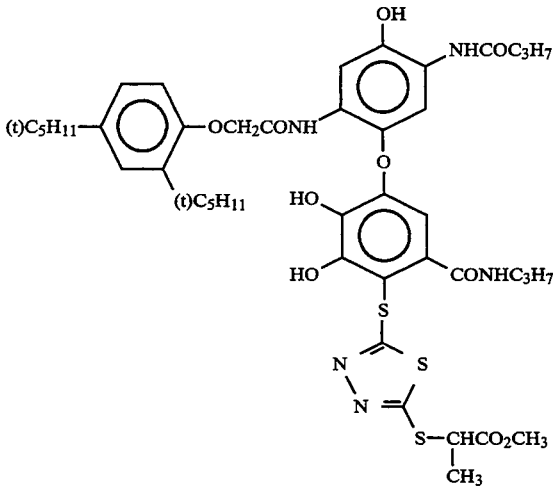

-continued
(D-37)
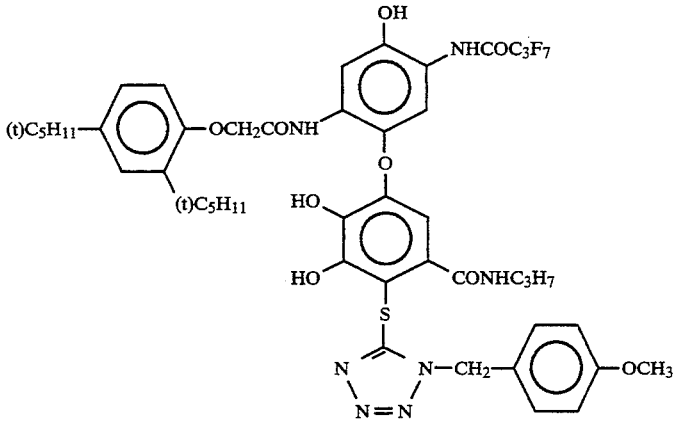
(D-38)
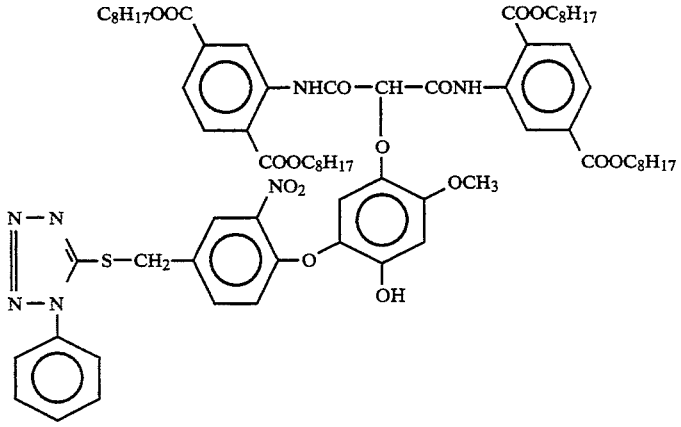
(D-39)
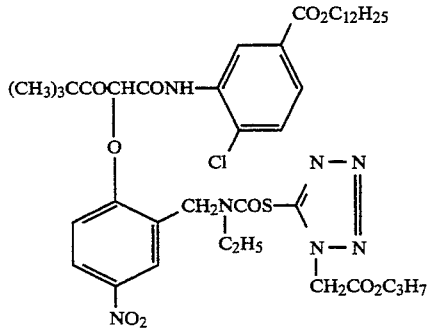
(D-40)
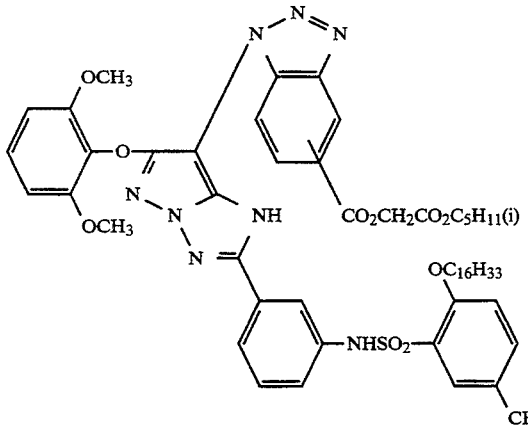
Note that in the formulas (D-3), (D-4), (D-6) and (D-40), the mark "{" means that the substituent connects to 5- or 6-position of the benzotriazolyl.
These couplers of the present invention can be synthesized by the methods described in, e.g., JP-A-54-145135, JP-A-63-37346, JP-A-56-114946, JP-A-57-

154234, JP-A-58-162949, JP-A-63-37350, JP-A-57-151944, JP-A-58-205150, JP-A-60-218645, U.S. Pat. Nos. 4,618,571 and 4,770,982, JP-A-63-284159, JP-A-60-203943, and JP-A-63-23152.

To obtain a satisfactory interlayer effect from an interlayer effect-imparting layer (containing tabular silver halide grains having dislocation lines) in the light-sensitive material, these couplers of the present invention are used in an amount of 30 mole % or more, preferably 50 mole % to 100 mole % with respect to the total amount of all couplers used in the interlayer effect-imparting layer. The addition amount of the couplers is $1\times10^{-6}$ to $1\times10^{-2}$ mole/m$^2$, preferably $5\times10^{-5}$ to $1\times10^{-3}$ mole/m$^2$.

The couplers of the present invention can be added in the same manner as ordinary couplers as will be described later.

Techniques and inorganic and organic materials usable in the color photographic light-sensitive material of the present invention are described in the portions of EP 436,938A2 described below, as well as the patents cited below.

1. Layer arrangements: page 146, line 34 to page 147, line 25
2. Silver halide emulsions: page 147, line 26 to page 148, line 12
3. Yellow couplers: page 137, line 35 to page 146, line 33, and page 149, lines 21 to 23
4. Magenta couplers: page 149, lines 24 to 28; EP 421,453A1, page 3, line 5 to page 25, line 55
5. Cyan couplers: page 149, lines 29 to 33; EP 432,804A2, page 3, line 28 to page 40, line 2
6. Polymer couplers: page 149, lines 34 to 38; EP 435,334A2, page 113, line 39 to page 123, line 37
7. Colored couplers: page 53, line 42 to page 137, line 34, and page 149, lines 39 to 45
8. Other functional couplers: page 7, line 1 to page 53, line 41, and page 149, line 46 to page 150, line 3; EP 435,334A2, page 3, line 1 to page 29, line 50
9. Antiseptic and mildewproofing agents: page 150, lines 25 to 28
10. Formalin scavengers: page 149, lines 15 to 17
11. Other additives: page 153, lines 38 to 47; EP 421,453A1, page 75, line 21 to page 84, line 56, and page 27, line 40 to page 37, line 40
12. Dispersion methods: page 150, lines 4 to 24
13. Supports: page 150, lines 32 to 34
14. Thickness and physical properties of film: page 150, lines 35 to 49
15. Color development process: page 150, line 50 to page 151, line 47
16. Desilvering process: page 151, line 48 to page 152, line 53
17. Automatic developing machine: page 152, line 54 to page 153, line 2
18. Washing/stabilizing process: page 153, lines 3 to 37

EXAMPLE 1

(1) Preparation of Emulsions

Emulsion A (Tabular Grains Having No Dislocation Lines: A Comparative Emulsion)

4.8 g of potassium bromide and 7.0 g of low molecular weight gelatin disclosed in JP-A-1-158426 were dissolved in 1 liter of distilled water to make a solution. While maintaining the temperature of the solution at 50° C., 25 cc of 2M silver nitrate aqueous solution containing gelatin, and 25 cc of 2M potassium bromide aqueous solution containing gelatin were added to the above solution over 1 minute by the double jet method. Then, the temperature was increased to 70° C., and 300 cc of 10 wt % gelatin aqueous solution was added.

Then, 30 cc of 1M silver nitrate aqueous solution was added to the solution over 5 minutes, and then 10 cc of 25 wt % ammonia water was added, and the mixture was subjected to ripening at 70° C. After ripening, the ammonia was neutralized. While maintaining pBr at 2.1, 1M silver nitrate aqueous solution and 1M potassium bromide aqueous solution were added at an accelerating flow rate (the flow rate at the end was 5 times as high as that of the beginning) by the double jet. (The amount of silver nitrate aqueous solution used was 600 cc.) The emulsion thus prepared was desalted and washed with water by the general flocculation method, and gelatin was added, thereby obtaining a seed emulsion AX made of tabular silver bromide grains. The amount of the seed emulsion AX obtained was 800 g.

Next, to 250 g of the seed emulsion AX were added 800 cc of distilled water, 30 g of gelatin, and 6.5 g of potassium bromide. The mixture was heated to a temperature of 75° C. and stirred, to which 1M silver nitrate aqueous solution and 1M potassium halide aqueous solution (a mixture of 94 mole % potassium bromide and 6 mole % potassium iodide) were added by the double jet at an accelerating flow rate (the flow rate at the end was 3 times as high as that of the beginning), while maintaining pBr at 1.7. (The amount of silver nitrate aqueous solution used was 500 cc.) The temperature was decreased to 50° C., and 1M silver nitrate aqueous solution and 1M potassium bromide aqueous solution were added by the double jet at a constant flow rate, while maintaining pBr at 1.8. (The amount of silver nitrate aqueous solution used was 300 cc.) The emulsion thus prepared was desalted and washed with water as for the seed emulsion AX, gelatin was added, and the pH was adjusted to 6.5, thereby obtaining an emulsion A.

The emulsion A was a tabular silver iodobromide emulsion having a silver iodide content of 3 mole %, and the grains having an aspect ratio of 5.0 or more occupy 50% or more of the total projected area. The average grain size (equivalent-sphere diameter) was 0.92 μm, with a variation coefficient of 19%.

Emulsion B (Tabular Grains Having No Dislocation Lines: A Comparative Emulsion)

4.8 g of potassium bromide and 5.0 g of low molecular weight gelatin used in the preparation of the emulsion A were dissolved into 1 liter of distilled water to make a solution. While maintaining the temperature of the solution at 40° C., 30 cc of 2M silver nitrate aqueous solution containing gelatin, and 30 cc of 2M pottasium bromide aqueous solution containing gelatin were added over 1 minute by the double jet method. Then, the temperature was increased to 70° C., and 300 cc of 10 wt % gelatin solution was added. Next, 30 cc of 1M silver nitrate aqueous solution was added over 5 minutes, and 8 cc of 25 wt % ammonia water was further added. The mixture was subjected to ripening at 70° C. After ripening, the ammonia was neutralized. Then, grains are grown in a similar manner to the seed emulsion AX. The emulsion thus prepared was desalted and washed with water by the flocculation method, thereby obtaining a seed emulsion BX made of tabular silver bromide grains. The amount of the seed emulsion BX obtained was 800 g.

Next, to 250 g of the seed emulsion BX were added 800 cc of distilled water, 30 g of gelatin, and 6.5 g of potassium bromide. The mixture was heated to a temperature of 75° C. and stirred, to which 1M silver nitrate aqueous solution and 1M potassium halide aqueous solution (a mixture of 90 mole % potassium bromide and 10 mole % potassium iodide) were added by the double jet at an accelerating flow rate (the flow rate at the end was 3 times as high as that of the beginning), while maintaining pBr at 1.7. (The amount of silver nitrate aqueous solution used was 500 cc.) Then, the temperature was decreased to 50° C., and 1M silver nitrate aqueous solution and 1M potassium bromide aqueous solution were added by the double jet at a constant flow rate, while maintaining pBr at 1.8. (The amount of silver nitrate aqueous solution used was 300 cc.) The emulsion thus prepared was desalted and washed with water, gelatin was added, and the pH was adjusted to 6.5, thereby obtaining an emulsion B.

The emulsion B was a tabular silver iodobromide emulsion having a silver iodide content of 5 mole %, and the grains having an aspect ratio of 5.0 or more occupy 40% or more of the total projected area. The average grain size (equivalent-sphere diameter) was 0.76 μm, with a variation coefficient of 20%.

Emulsion C (Tabular Grains Having Dislocation Lines: An Emulsion of the Present Invention)

To 250 g of seed emulsion BX were added 800 cc of distilled water, 30 g of gelatin, and 6.5 g of potassium bromide. The mixture was heated to a temperature of 75° C. and stirred, to which 1M silver nitrate aqueous solution and 1M potassium halide aqueous solution (a mixture of 94 mole % potassium bromide and 6 mole % potassium iodide) were added by the double jet at an accelerating flow rate (the flow rate at the end was 3 times as high as that of the beginning), while maintaining pBr at 1.7. (The amount of silver nitrate aqueous solution used was 500 cc.) Then, the temperature was decreased to 50° C., and 35 cc of 1M silver nitrate aqueous solution and 125 cc of 0.2M potassium iodide aqueous solution were added by the double jet at a constant flow rate over five minutes. Further, 265 cc of 1M silver nitrate aqueous solution and 265 cc of 1M potassium bromide aqueous solution were added by the double jet at a constant flow rate. The emulsion thus prepared was desalted and washed with water, gelatin was added as for emulsion A, and the pH of the resultant was adjusted to 6.5, thereby obtaining an emulsion C.

The emulsion C was a tabular silver iodobromide emulsion having a silver iodide content of 5.4 mole %, and the grains having an aspect ratio of 5.0 or more occupy 40% or more of the total projected area. The average grain size (equivalent-sphere diameter) was 0.76 μm, with a variation coefficient of 19%.

Emulsion D (Octahedral Grains: A Comparative Emulsion)

One liter of aqueous gelatin solution containing 0.012 mole of potassium bromide and 1.0 mole of ammonia was maintained at 70° C., and while stirring the solution, 500 cc of an aqueous solution containing 0.27 mole of silver nitrate, and 500 cc of an aqueous solution containing 0.24 mole of potassium bromide and 0.043 mole of potassium iodide were added by the double jet over 35 minutes. During the addition, the potential of silver was adjusted to maintain −5 mV with respect to the saturated calomel electrode. Thereafter, the ammonia was neutralized with an acid, and 500 cc of an aqueous solution containing 0.62 mole of silver nitrate, and 500 cc of an aqueous solution containing 0.72 mole of potassium bromide and 0.002 mole of potassium iodide were added by the double jet over 40 minutes. During the addition, the potential of silver was adjusted to maintain −5 mV with respect to the saturated calomel electrode. The emulsion thus obtained was desalted and washed with water as for the emulsion A, and the pH was adjusted to 6.5, thereby obtaining an emulsion D.

The emulsion D was a monodisperse octahedral silver iodobromide emulsion having a core/shell structure and a silver iodide content of 5.1 mole %, and the average grain size (equivalent-sphere diameter) was 0.88 μm, with a variation coefficient of 12%.

Emulsion E (Twin Grains Having a Low Aspect Ratio: A Comparative Emulsion)

20 g of inert gelatin, 3.2 g of potassium bromide, and 0.98 g of potassium iodide were dissolved into 800 of distilled water to make a solution. While stirring the solution at 50° C., 150 cc of an aqueous solution containing 5 g of silver nitrate was instantaneously added. Further, after an excessive amount of potassium bromide and ammonia aqueous solution were added, the mixture was subjected to physical ripening for 15 minutes. Then, the ammonia was neutralized, and the temperature of the solution was decreased to 65° C. Then, according to the method disclosed in U.S. Pat. No. 4,242,455, 0.2 mole/liter, 0.67 mole/liter, and 2 mole/liter of silver nitrate and potassium halide (mixture of 80 mole % potassium bromide and 20 mole % of potassium iodide) were added each at a flow rate of 10 cc per minute to grow silver iodobromide grains having a silver iodide content of 20 mole %. The emulsion thus prepared was desalted and washed with water as for the emulsion A, thereby obtaining seed emulsion EX. The amount of the seed emulsion EX obtained was 900 g.

Next, to 250 g of the seed emulsion EX were added 850 cc of distilled water, and 300 cc of 10% potassium bromide aqueous solution, and the mixture was heated to a temperature of 75° C. and stirred, to which one liter of an aqueous solution of 144 g of silver nitrate and one liter of an aqueous solution of 108 g of potassium bromide were simultaneously added over 65 minutes. After the seed emulsion EX was grown without causing renucleation of the emulsion EX, the emulsion was desalted and washed with water, and gelatin was added, and the pH was adjusted to 6.5, thereby obtaining an emulsion E.

The emulsion E was a twin crystal grain silver iodobromide emulsion having a silver iodide content of 5.6 mole %. The average grain size (equivalent-sphere diameter) was 0.83 μm, with a variation coefficient of 27%. The grains having an aspect ratio of 3.0 or more occupy 20% or less of the total projected area.

The emulsions A to E were observed by a 200 KV transmission electron microscope at a liquid nitrogen temperature, and no dislocation lines were found in substantially any of the grains of the emulsions A and B. In the emulsion C, many dislocation lines were found in the entire peripheral region of each tabular grain. As regards the emulsions D and E, the grains were too thick for electron beams to transmit therethrough, and therefore the presence of dislocation lines could not be confirmed.

In the emulsion C, the exact number of dislocation lines could not be obtained, but there were obviously 20 or more dislocation lines present per grain.

The characteristics of the emulsions A to E are summarized in Table 1 below.

TABLE 1

| Emulsion No. | Characters: Grain shape | Aspect ratio*1 | Grain size (equivalent-sphere) μm | Variation coefficient | Silver iodide content | dislocation lines |
|---|---|---|---|---|---|---|
| Emulsion A (comparative) | tabular | grains having a ratio of 5.0 or more occupy 50% or more | 0.92 μm | 19% | 3.0 mole % | ca. 0 |
| Emulsion B (comparative) | tabular | grains having a ratio of 5.0 or more occupy 40% or more | 0.76 μm | 20% | 5.0 mole % | ca. 0 |
| Emulsion C (invention) | tabular | grains having a ratio of 5.0 or more occupy 40% or more | 0.76 μm | 19% | 5.4 mole % | 20 or more |
| Emulsion D (comparative) | octahedral | 1 | 0.90 μm | 12% | 5.1 mole % | presence, or absence, not detected |
| Emulsion E (comparative) | twin | grains having a ratio of 3.0 or more occupy 20% or more | 0.83 μm | 27% | 5.6 mole % | presence, or absence, not detected |

Aspect ratio: amount of grains having the indicated aspect ratio value with respect to the total projected area of all the grains To each of the above 5 emulsions (emulsions A to E), spectral sensitizing dyes SO-1, SO-2, and SO-3 indicated below were added in amounts specified in Table 2 below. Each mixture was heated to 62° C., and held at that temperature for 20 minutes. Then, each emulsion was subjected to optimal chemical sensitization at 62° C. and pH of 6.5 by using sodium thiosulfate, chloroauric acid, and potassium thiocyanate, thereby obtaining emulsions A-1 to E-1. Here, the optimal chemical sensitization means a chemical sensitization which brings about the highest value of sensitivity upon 1/100 second exposure after the chemical sensitization.

SO-1

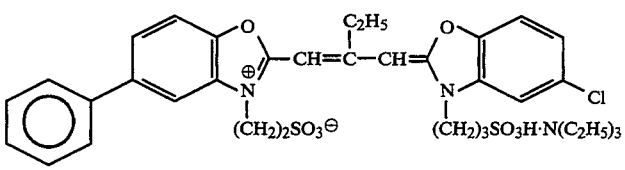

SO-2

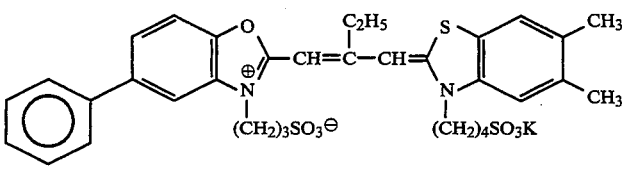

SO-3

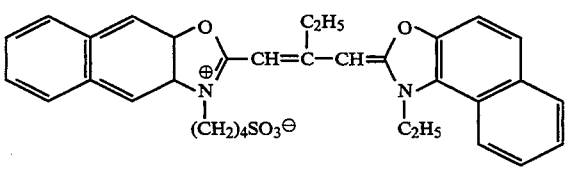

TABLE 2

| Emulsion No. | Emulsion used | Amount of sensitizing dye added* (mole/Ag mole): SO-1 | SO-2 | SO-3 |
|---|---|---|---|---|
| A-1 (comparative) | emulsion A | $3.90 \times 10^{-4}$ | $0.40 \times 10^{-4}$ | $1.11 \times 10^{-4}$ |
| B-1 (comparative) | emulsion B | $4.64 \times 10^{-4}$ | $0.48 \times 10^{-4}$ | $1.32 \times 10^{-4}$ |
| C-1 (invention) | emulsion C | $4.64 \times 10^{-4}$ | $0.48 \times 10^{-4}$ | $1.32 \times 10^{-4}$ |
| D-1 (comparative) | emulsion D | $2.92 \times 10^{-4}$ | $0.30 \times 10^{-4}$ | $0.83 \times 10^{-4}$ |
| E-1 (comparative) | emulsion D | $3.71 \times 10^{-4}$ | $0.38 \times 10^{-4}$ | $1.06 \times 10^{-4}$ |

*expressed in amount added (mole) per mole of silver (2) Preparation of Coating Samples The 5 emulsions (emulsion A-1, B-1, C-1, D-1, and E-1), chemically sensitized as above, were each coated on a triacetylcellurose film support provided with a subbing layer, and a protective layer was further formed on the emulsion layer, under the following coating condition I, thereby preparing color samples 1 to 5. Likewise, an emulsion layer and a protective layer were coated under the following coating condition II, thereby preparing color samples 6 to 10.

The composition of each of the color samples 1 to 10 will be listed in the following Table 3.

EMULSION COATING CONDITION I

| | |
|---|---|
| Emulsion Layer | |
| Emulsion: A-1, B-1, C-1, D-1, or E-1 | (silver 0.45 g/m$^2$) |
| Coupler: Magenta Coupler MC-1 represented by the following formula | ($7.4 \times 10^{-4}$ mole/m$^2$) |
| Tricresyl phosphate | (0.52 g/m$^2$) |
| Gelatin | (2.0 g/m$^2$) |
| Protective Layer | |
| 2,4-dichloro-6-hydroxy-S-triazine sodium salt | (0.08 g/m$^2$) |
| Gelatin | (1.8 g/m$^2$) |

MC1

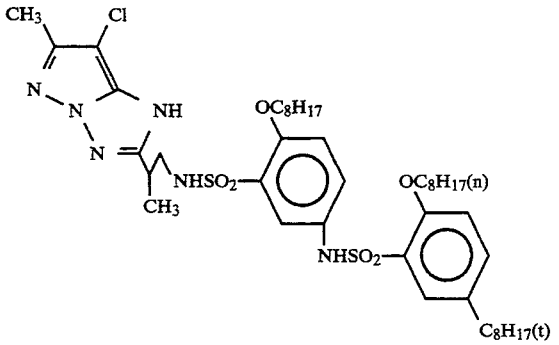

EMULSION COATING CONDITION II

The same as the emulsion coating condition I except that the coupler MC-1 in the emulsion layer was replaced with an equimolar amount of exemplified coupler D-31 of the invention.

(3) EVALUATION

The samples 1 to 12 were allowed to stand at a temperature of 40° C. and a relative humidity of 70% for 14 hours. The samples were then exposed for 1/100 second through a 4800° K. color-temperature conversion filter, an SC-50 Fuji filter (yellow filter) which transmits light having a wavelength longer than 500 nm, and a continuous wedge. Thereafter, a color development process was carried out on each sample.

| Development Process | | |
|---|---|---|
| Steps | Time | Temperature |
| Color Development | 2 min 00 sec | 40° C. |
| Bleach-Fixing | 3 min 00 sec | 40° C. |
| Water washing (1) | 20 sec | 35° C. |
| Water washing (2) | 20 sec | 35° C. |
| Stabilization | 20 sec | 35° C. |
| Drying | 50 sec | 65° C. |

The compositions of the respective processing solutions were as follows:

| | (unit: g) |
|---|---|
| (Color Developing Solution) | |
| Diethylenetriaminepentaacetic acid | 2.0 |
| 1-hydroxyethylidene-1,1-diphosphonic acid | 3.0 |

-continued

| | (unit: g) |
|---|---|
| Sodium sulfite | 4.0 |
| Potassium carbonate | 30.0 |
| Potassium bromide | 1.4 |
| Potassium iodide | 1.5 mg |
| Hydroxyamine sulfate | 2.4 |
| 4-[N-ethyl-N-β-hydroxyethylamino]-2-methylaniline sulfate | 4.5 |
| Water to make | 1.0 liter |
| pH | 10.05 |
| (Bleach-fixing solution) | |
| Ammonium ferric ethylenediaminetetraacetate dihydrate | 90.0 |
| Disodium ethylenediaminetetraacetate dihydrate | 5.0 |
| Sodium sulfite | 12.0 |
| Ammonium thiosulfate aqueous solution (70%) | 260.0 ml |
| Acetic acid (98%) | 5.0 ml |
| Bleaching accelerator $(CH_3)_2NCH_2CH_2S—SCH_2CH_2N(CH_3)_2.2HCl)$ | 0.01 mole |
| Water to make | 1.0 liter |

(Water-washing solution)

Tap water was passed through a mixed-bed column filled with H-type strongly acdic cation-exchange resin (Amberlite IR-120B available from Rohm and Haas, Co.) and OH-type anion-exchange resin (Amberlite IR-400), whereby the calcium and magnesium ion concentration of the water was reduced to 3 mg/liter or less. Further, 20 mg/liter of sodium isocyanurate dichloride and 1.5 g/liter of sodium nitrate were added. The solution had a pH in a range of 6.5–7.5.

| (Stabilizing Solution) | (unit: g) |
|---|---|
| Formalin (37%) | 2.0 ml |
| Polyoxyethylene-p-monononylphenyl ether (average polymerization degree: 10) | 0.3 |
| Disodium ethylenediaminetetraacetate | 0.05 |
| Water to make | 1.0 liter |
| pH | 5.0–8.0 |

Using a green filter, the transmission density of each processed sample was measured, and a fog, a sensitivity and a contrast were determined.

The sensitivity of each sample is represented by a relative value of a reciprocal of an exposure amount (lux.sec) which gives a density of fog+0.2.

The contrast is represented by the relative value of a reciprocal of the value obtained by subtracting the logarithm of an exposure amount which gives a density of fog+1.2 from the logarithm of an exposure amount which gives a density of fog+0.2.

Further, in order to determine changes in propriety of the samples when the DIR coupler D-31 of the invention, which releases a diffusing development inhibitor, was used, rates of changes in sensitivity and contrast for the samples using the coupler D-31 were calculated with respect to the sensitivity and contrast of the samples using the coupler MC-1 alone.

The results were as shown in Table 3 below. As can be seen from the Table 3, the sensitivity and contrast were always lowered when the coupler MC-1 was replaced with the diffusing development inhibitor-releasing coupler D-31. However, the sample 8, in which the emulsion of the invention was used, had a smaller degree of lowering of the sensitivity and contrast than when other emulsions were used, indicating that disadvantages resulting from the use of the coupler D-31 were significantly remedied.

TABLE 3

| Sample contents | | | | Photographic performances | | | Rate of change when MC-1 was replaced with D-31 | |
|---|---|---|---|---|---|---|---|---|
| | | Coupler*1 | | | | | | |
| Sample No. | Emulsion No. | MC-1 | Compound D-31 | Fog | Sensitivity*2 | Contrast*3 | Sensitivity | Contrast |
| 1 (comparative example) | A-1 | ○ | x | 0.15 | 100 | 1.00 | | |
| 2 (comparative example) | B-1 | ○ | x | 0.10 | 71 | 1.05 | | |
| 3 (comparative example) | C-1 | ○ | x | 0.12 | 100 | 1.03 | | |
| 4 (comparative example) | D-1 | ○ | x | 0.14 | 100 | 0.97 | | |
| 5 (comparative example) | E-1 | ○ | x | 0.12 | 100 | 0.88 | | |
| 6 (comparative example) | A-1 | x | ○ | 0.10 | 47 | 0.43 | 0.47 | 0.43 |
| 7 (comparative example) | B-1 | x | ○ | 0.08 | 36 | 0.50 | 0.51 | 0.48 |
| 8 (present invention) | C-1 | x | ○ | 0.09 | 62 | 0.67 | 0.62 | 0.65 |
| 9 (comparative example) | D-1 | x | ○ | 0.10 | 45 | 0.41 | 0.45 | 0.42 |
| 10 (comparative example) | E-1 | x | ○ | 0.09 | 50 | 0.45 | 0.50 | 0.51 |

*1 ○ indicates presence, x indicates absence
*2Expressed by relative value with respect to 100 of sensitivity of sample 1
*3Expressed by relative value with respect to 1.00 of contrast of sample 1

EXAMPLE 2

(1) Preparation of Emulsions

Emulsion F (Tabular Grains Having No Dislocation Lines: A Comparative Emulsion)

While one liter of aqueous solution containing 10.5 g of gelatin and 3.0 g of potassium bromide was maintained at 60° C. and stirred, a silver nitrate aqueous solution ($AgNO_3$ 7.3 g), and a halide aqueous solution (KBr 5.1 g, KI 0.31 g) were added over one minute by the double jet method. After addition of 21.5 g of gelatin, the temperature was raised to 75° C. Then, a silver nitrate aqueous solution ($AgNO_3$ 136.3 g) and a halide aqueous solution (containing 4.4 mole % of KI with respect to KBr) were added by the double jet method over 51 minutes with an accelerated flow rate. During the period, the silver potential was kept at 0 mV with respect to the saturated calomel electrode. Thereafter, the temperature was decreased to 40° C., and a silver nitrate aqueous solution ($AgNO_3$ 28.6 g) and a potassium bromide aqueous solution were added by the double jet method over 5.35 minutes. During the addition period, the silver potential was kept at −50 mV with respect to the saturated calomel electrode. An emulsion thus obtained was desalted and washed with water by the conventional flocculation method, gelatin was further added, and the pH was adjusted to 6.5, thereby obtaining an emulsion F.

The emulsion F was a tabular silver iodobromide grain emulsion having an average equivalent-circle diameter of 1.31 μm, and an average thickness of 0.22 μm, and the grains having an aspect ratio of 5.0 or more occupy 50% or more of the total projected area. The average grain size (equivalent-sphere diameter) was 0.83 μm.

Emulsion G (Tabular Grains Having Dislocation Lines: An Emulsion of the Invention)

While one liter of an aqueous solution containing 10.5 g of gelatin and 3.0 g of potassium iodide was heated to 60° C., and stirred, a silver nitrate aqueous solution ($AgNO_3$ 7.3 g), and a halide aqueous solution (KBr 5.1 g, KI 0.31 g) were added over one minute by the double jet method. After addition of 21.5 g of gelatin, the temperature was raised to 75° C. Then, a silver nitrate aqueous solution ($AgNO_3$ 136.3 g) and a halide aqueous solution (containing 4.4 mole % of KI with respect to KBr) were added by the double jet method over 51 minutes with an accelerated flow rate. During the period, the silver potential was kept at 0 mV with respect to the saturated calomel electrode. Thereafter, the temperature was decreased to 40° C., and a silver nitrate aqueous solution ($AgNO_3$ 3.2 g) and a potassium aqueous iodide solution (KI 2.4 g) were added by the double jet method over 5 minutes. Then, a silver nitrate aqueous solution ($AgNO_3$ 25.4 g) and a potassium bromide aqueous solution were added over 5.35 minutes by the double jet method. During the addition period, the silver potential was kept at −50 mV with respect to the saturated calomel electrode. From the flocculation step on, the same treatment was conducted as for the emulsion F, thereby obtaining an emulsion G.

The emulsion G was a tabular silver iodobromide grain emulsion having an average equivalent-circle diameter of 1.26 μm, and an average thickness of 0.24 μm, and the grains having an aspect ratio of 5.0 or more occupy 40% or more of the total projected area. The average grain size (equivalent-sphere diameter) was 0.83 μm.

The emulsions F and G were observed by a 200 KV transmission electron microscope as in Example 1. No dislocation lines were found in substantially any of the grains of the emulsion F, whereas in the emulsion G, many dislocation lines were found in the entire peripheral region of each tabular grain. In the emulsion G, the exact number of dislocation lines could not be obtained, but there were obviously 20 or more dislocation lines present per grain.

Next, to each of the emulsions F and G, spectral sensitization dyes SP-1, SP-2, and SP-3 indicated below were added in amounts of $3.3\times10^{-4}$ mole, $1.0\times10^{-5}$, and $1.6\times10^{-4}$, respectively. Each mixture was heated to 64° C., and held at that temperature for 20 minutes, while being stirred. Then, each emulsion was subjected to optimal chemical sensitization at 64° C. and pH of 5.8 by using sodium thiosulfate, chloroauric acid, potassium thiocyanate, and triphenylphosphineselenide, thereby obtaining emulsions F-1 and G-1. Here, the amount of triphenylphosphineselenide used for each of the emulsions F and G, was ¼ of that of sodium thiosulfate in mole.

SP-1

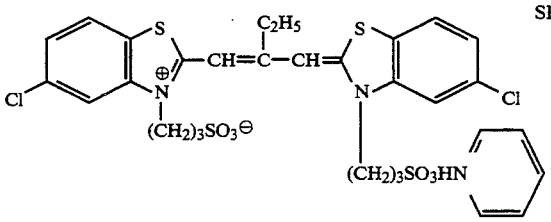

SP-2

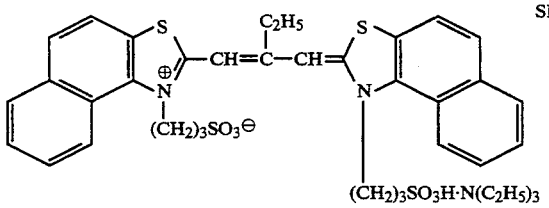

SP-3

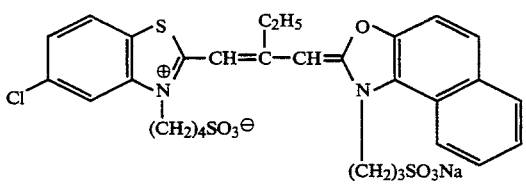

(2) Preparation of Coated Samples (Preparation of Samples 11 and 12)

The emulsions F-1 and G-1 were each coated on a subbed triacetylcellurose film support to form an emulsion layer, and a protective layer was formed on the emulsion layer, under the following coating condition III, thereby obtaining samples 11 and 12.

Emulsion Coating Condition III:

| | |
|---|---|
| Emulsion Layer | |
| Emulsion: F-1 (sample 11), or G-1 (sample 12) | (silver 0.96 g/m²) |
| Coupler: Cyan coupler CC-1 indicated below | ($9.2\times10^{-4}$ mole/m²) |
| Tricresylphosphate | (0.52 g/m²) |

-continued

| | |
|---|---|
| Gelatin | (2.0 g/m²) |
| Protective Layer | |
| 2,4-dichloro-6-hydroxy-S-triazine sodium salt | (0.08 g/m²) |
| Gelatin | (1.8 g/m²) |

CC-1

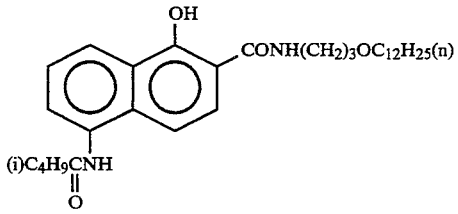

(Preparation of samples 13 and 14)

Samples 13 and 14 were prepared by the same procedures as for the samples 11 and 12 except that the coupler CC-1 was replaced with a mixture of 70 mole % of CC-1, and 30 mole % of exemplified coupler D-9 of the present invention. (The total amount of the couplers in each emulsion was the same in mole as that of the sample 11 or 12.)

(Preparation of samples 15 and 16)

Samples 15 and 16 were prepared by the same procedures as for the samples 11 and 12 except that the coupler CC-1 was replaced with a mixture of 50 mole % of CC-1, and 50 mole % of exemplified coupler D-36 of the present invention. (The total amount of the couplers in each emulsion was the same in mole as that of the sample 11 or 12.)

(Preparation of samples 17 and 18)

Samples 17 and 18 were prepared by the same procedures as for the samples 11 and 12 except that the coupler CC-1 was replaced with a mixture of 30 mole % of CC-1, and 70 mole % of exemplified coupler D-20 of the present invention. (The total amount of the couplers in each emulsion was the same in mole as that of the sample 11 or 12.)

The contents of each of the samples 11–18 were as listed in Table 4 below.

(3) Evaluation

As in Example 1, the samples 11–18 were allowed to stand at a temperature of 40° C. and a relative humidity of 70% for 14 hours, and then exposed for 1/100 second through a 4800° K. color-temperature conversion filter, an SC-62 Fuji filter (red filter) which transmits the light having a wavelength longer than 620 nm, and a continuous wedge. Further, a color development was carried out as in Example 1 on each sample.

Using a red filter, the transmission density of each of the processed samples was measured, and a fog, sensitivity and contrast were determined. The sensitivity and contrast were obtained by the same method as in Example 1.

Further, as in Example 1, rates of changes in sensitivity and contrast were calculated for the samples using the mixture of CC-1 and D-9, the mixture of CC-1 and D-36, or the mixture of CC-1 and D-20 with respect to the samples using the coupler CC-1 alone.

The results were as shown in Table 4 below. As can be seen from the Table 4, when the couplers D-9, D-36, and D-20 were used, the samples of the present invention, which use tabular silver halide emulsion having 20 or more dislocation lines, exhibited a smaller degree of lowering of the sensitivity and contrast than the samples using emulsions having few dislocation lines.

TABLE 4

| Sample contents | | | | | | | Photographic performances | | | Rate of change with respect to 100 mole % of of CC-1 | |
|---|---|---|---|---|---|---|---|---|---|---|---|
| | Emulsion | | Coupler (mole %) | | | | | | | | |
| Sample No. | Emulsion No. | Dislocation line | CC-1 | Compound D-9 | Compound D-36 | Compound D-20 | Fog | Sensitivity*1 | Contrast*2 | Sensitivity | Contrast |
| 11 (comparative example) | F-1 | ca. 0 | 100 mole % | | | | 0.16 | 100 | 1.00 | | |
| 12 (comparative example) | G-1 | 20 or more | 100 mole % | | | | 0.16 | 151 | 0.98 | | |
| 13 (comparative example) | F-1 | ca. 0 | 70 mole % | 30 mole % | | | 0.15 | 58 | 0.35 | 0.58 | 0.35 |
| 14 (Present invention) | G-1 | 20 or more | 70 mole % | 30 mole % | | | 0.15 | 119 | 0.49 | 0.79 | 0.50 |
| 15 (comparative example) | F-1 | ca. 0 | 50 mole % | | 50 mole % | | 0.15 | 48 | 0.31 | 0.48 | 0.31 |
| 16 (present invention) | G-1 | 20 or more | 50 mole % | | 50 mole % | | 0.15 | 107 | 0.46 | 0.71 | 0.47 |
| 17 (comparative example) | F-1 | ca. 0 | 30 mole % | | | 70 mole % | 0.15 | 50 | 0.28 | 0.50 | 0.28 |
| 18 (present invention) | G-1 | 20 or more | 30 mole % | | | 70 mole % | 0.15 | 112 | 0.40 | 0.74 | 0.41 |

*1expressed by relative value with respect to 100 of sensitivity of sample 11
*2expressed by relative value with respect to 1.00 of contrast of sample 11

EXAMPLE 3

(1) Preparation of Emulsions

Emulsion H (Tabular Grains Having No Dislocation Lines: A Comparative Emulsion)

While one liter of an aqueous solution containing 10.5 g of gelatin and 4.0 g of potassium bromide was maintained at 35° C., and stirred well, a silver nitrate aqueous solution ($AgNO_3$ 8.3 g), and a halide aqueous solution (KBr 5.54 g, KI 0.37 g) were added over 30 minutes by the double jet method. After addition of 21.5 g of gelatin, the temperature was raised to 63° C. Then, a silver nitrate aqueous solution was added, and the silver potential was adjusted to −20 mV with respect to the saturated calomel electrode. Further, 3 cc of 25-weight % ammonia water was added, and the mixture was subjected to ripening at 63° C. After the ripening, the ammonia was neutralized, and a silver nitrate aqueous solution ($AgNO_3$ 136.3 g) and a halide aqueous solution (containing 4.4 mole % of KI with respect to KBr) were added by the double jet method over 51 minutes with an accelerated flow rate. During the addition period, for the first 46 minutes, the silver potential was kept at −20 mV with respect to the saturated calomel electrode, and then adjusted to 0 mV for the rest of the time. Then, the temperature was decreased to 40° C., and a silver nitrate aqueous solution ($AgNO_3$ 28.6 g) and a potassium bromide aqueous solution were added by the double jet method over 6 minutes. During the addition period, the silver potential was kept at −40 mV with respect to the saturated calomel electrode. An emulsion thus obtained was desalted and washed with water by the conventional flocculation method, gelatin was added, and the pH was adjusted to 6.5, thereby obtaining an emulsion H.

The emulsion H was a tabular silver iodobromide emulsion having an average equivalent-circle diameter of 0.76 μm, and an average thickness of 0.19 μm, and the grains having an aspect ratio of 3.0 or more occupy 50% or more of the total projected area. The average grain size (equivalent-sphere diameter) was 0.56 μm.

Emulsion I (Tabular Grains Having Dislocation Lines: An Emulsion of the Invention)

The steps up to the neutralization of the ammonia solution after the ammonia ripening at 63° C. were the same as those for the emulsion H. Then, a silver nitrate aqueous solution ($AgNO_3$ 136.3 g) and a halide aqueous solution (containing 4.2 mole % of KI with respect to KBr) were added by the double jet method over 51 minutes with an accelerated flow rate. During the addition period, for the first 46 minutes, the silver potential was kept at −20 mV with respect to the saturated calomel electrode, and then adjusted to 0 mV for the rest of the time. Then, the temperature was decreased to 40° C., and a silver nitrate aqueous solution ($AgNO_3$ 3.6 g) and a potassium iodide aqueous solution (KI 2.7 g) were added over 5 minutes. Then, a silver nitrate aqueous solution ($AgNO_3$ 25.0 g) and a potassium bromide aqueous solution were added by the double jet method over 5.35 minutes. During the addition period, the silver potential was kept at −40 mV with respect to the saturated calomel electrode. An emulsion thus obtained was desalted and washed with water by the conventional flocculation method, gelatin was added, and the pH was adjusted to 6.5, thereby obtaining an emulsion I.

The emulsion I was a tabular silver iodobromide emulsion having an average equivalent-circle diameter of 0.75 μm, and an average thickness of 0.20 μm, and the grains having an aspect ratio of 3.0 or more occupy 50% or more of the total projected area. The average grain size (equivalent-sphere diameter) was 0.56 μm.

The emulsions H and I were observed by a transmission electron microscope as in Example 1. No dislocation lines were found in substantially any of the grains of the emulsion H, whereas in the emulsion I, many dislocation lines were found in the entire peripheral region of each tabular grain. In the emulsion I, the exact number of dislocation lines could not be obtained, but there were obviously 20 or more dislocation lines present per grain.

Next, to each of the emulsions H and I, a spectral sensitizing dye SR-1 indicated below was added in an amount of $7.2\times10^{-4}$ mole. Each mixture was heated to 60° C., and held at that temperature for 20 minutes, while being stirred. Then, each emulsion was subjected to optimal chemical sensitization at 60° C., using sodium thiosulfate, chloroauric acid, and potassium thiocyanate, thereby obtaining emulsions H-1 and I-1.

SR-1

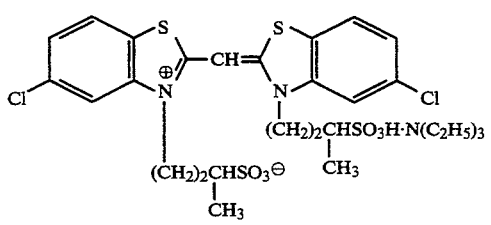

(2) Preparation of Coated Samples (Preparation of samples 19 and 20)

Each of the emulsions H-1 and I-1 was coated to form an emulsion layer on a subbed triacetylcellurose film support, and a protective layer was formed on the emulsion layer, under the following coating condition IV, thereby obtaining samples 19 and 20.

Emulsion Coating Condition IV

| | |
|---|---|
| Emulsion Layer | |
| Emulsion: H-1 (sample 19), or I-1 (sample 20) | (silver 0.90 g/m$^2$) |
| Coupler: Yellow coupler YC-1 indicated below | ($9.8\times10^{-4}$ mole/m$^2$) |
| Tricresylphosphate | (0.52 g/m$^2$) |
| Gelatin | (2.0 g/m$^2$) |
| Protective Layer | |
| 2,4-dichloro-6-hydroxy-S-triazine sodium salt | (0.08 g/m$^2$) |

-continued

| | |
|---|---|
| Gelatin | (1.8 g/m$^2$) |
| YC-1 | |

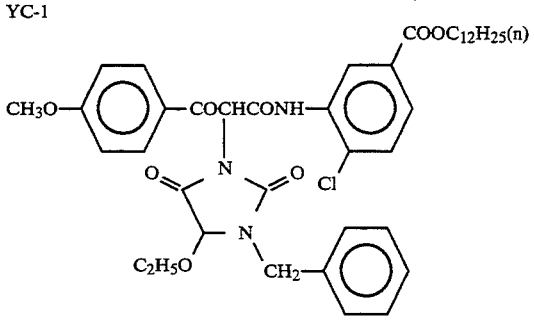

(Preparation of samples 21 and 22)

Samples 21 and 22 were prepared in the same manner as those for the samples 19 and 20 except that the coupler YC-1 was replaced with the mixture of 50 mole % of YC-1, and 50 mole % of example compound D-8 of the present invention. (The total amount of the couplers in each emulsion was set to be the same in mole as that of the sample 19 or 20.)

(3) Evaluation

As in Example 1, the samples 19 to 22 were allowed to stand at a temperature of 40° C. and a relative humidity of 70% for 14 hours, and then exposed for 1/100 second through a 4800° K. color-temperature conversion filter, and a continuous wedge. Further, a color development was carried out as in Example 1.

By use of a blue filter, the transmission density of each of the processed samples was measured and the fog, sensitivity and contrast were obtained. The sensitivity and contrast were obtained by the same method as in Example 1.

Further, as in Example 1, rates of changes in sensitivity and contrast were calculated for the samples using the mixture of YC-1 and D-8 with respect to the samples using the coupler YC-1 alone.

The results were as shown in Table 5 below. As can be seen from the Table 5, when the DIR couplers D-8 was used, the samples of the present invention, which used a tabular silver halide emulsion having 20 or more dislocation lines, exhibited a smaller degree of lowering of the sensitivity and contrast than the samples using emulsions having few dislocation lines in grains.

TABLE 5

| Sample contents | | | | | Photographic performances | | | Rate of change with respect to 100 mole % of YC-1 | |
|---|---|---|---|---|---|---|---|---|---|
| | Emulsion | | Coupler (mole %) | | | | | | |
| Sample No. | Emulsion No. | Dislocation line | YC-1 | Compound D-8 | Fog | Sensitivity*1 | Contrast*2 | Sensitivity | contrast |
| 19 (comparative example) | H-1 | ca. 0 | 100 mole % | | 0.17 | 100 | 1.00 | | |
| 20 (Present invention) | I-1 | 20 or more | 100 mole % | | 0.18 | 120 | 1.00 | | |
| 21 (comparative example) | H-1 | ca. 0 | 70 mole % | 30 mole % | 0.15 | 58 | 0.53 | 0.58 | 0.53 |
| 22 (present | I-1 | 20 or more | 70 mole % | 30 mole % | 0.15 | 85 | 0.70 | 0.71 | 0.70 |

TABLE 5-continued

| Sample contents | | | | | Photographic performances | | | Rate of change with respect to 100 mole % of YC-1 | |
|---|---|---|---|---|---|---|---|---|---|
| | Emulsion | | Coupler (mole %) | | | | | | |
| Sample No. | Emulsion No. | Dislocation line | YC-1 | Compound D-8 | Fog | Sensitivity*1 | Contrast*2 | Sensitivity | contrast |
| invention) | | | | | | | | | |

*1expressed by relative value with respect to 100 of sensitivity of sample 19
*2expressed by relative value with respect to 1.00 of contrast of sample 19

EXAMPLE 4

(1) Preparation of Emulsions (Emulsions A-2 and C-2)

To the emulsions A and C, a spectral sensitization dye SO-4 indicated below was added in amounts of $5.3\times10^{-4}$ mole and $6.4\times10^{-4}$ mole, per mole of silver, respectively. Each emulsion was heated to 62° C., and held at that temperature for 20 minutes. Then, the pH was adjusted to 5.8, and each emulsion was subjected to optimal chemical sensitization using sodium thiosulfate, chloroauric acid, potassium thiocyanate, and N,N-dimethylselenourea, thereby obtaining emulsions A-2 and C-2. In both of the emulsions A and C, the amount of N,N-dimethylselenourea was ⅓ of that of sodium thiosulfate in mole.

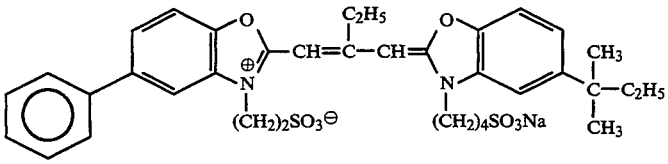

SO-4

(2) Preparation of Coated Samples (Preparation of Sample 101)

A multilayer color photographic light-sensitive material, sample 101, was prepared, which had the following layers, using the emulsion A-2 in layer 10.

Composition of Layers

The amount of each of silver halides and colloidal silver coated was expressed by silver amounts in unit of g/m². The amount of each of couplers, additives and gelatins was expressed in unit of g/m². The amount of each of additives was expressed in mole per mole of silver halide present in the same layer. The meanings of the reference symbols were as follows. In the case where a substance has two or more effects, the most typical one was listed.

UV: ultraviolet ray absorber, Solv: High-boiling point organic solvent, ExF: dye, ExS: sensitizing dye, ExC: cyan coupler, ExM: magenta coupler, ExY: yellow coupler, Cpd: additive

| Layer 1: Antihalation layer | |
|---|---|
| Black colloidal silver | 0.15 |
| Gelatin | 2.33 |
| ExM-2 | 0.11 |
| UV-1 | $3.0\times10^{-2}$ |
| UV-2 | $6.0\times10^{-2}$ |
| UV-3 | $7.0\times10^{-2}$ |
| Solv-1 | 0.16 |
| Solv-2 | 0.10 |
| ExF-1 | $1.0\times10^{-2}$ |

-continued

| | |
|---|---|
| ExF-2 | $4.0\times10^{-2}$ |
| ExF-3 | $5.0\times10^{-3}$ |
| Cpd-6 | $1.0\times10^{-3}$ |
| Layer 2 (Low-speed red-sensitive layer) | |
| Silver iodobromide emulsion (AgI 4.0 mole %, uniform AgI-type, equivalent-sphere diameter: 0.4 μm, variation coefficient of equivalent-sphere diameter: 30%, plate-like grains, and diameter/thickness ratio: 3.0) | Amount of coated silver 0.35 |
| Silver iodobromide emulsion (AgI 4.0 mole %, uniform AgI-type, equivalent-sphere diameter: 0.4 μm, variation coefficient of equivalent-sphere diameter: 30%, plate-like grains, and diameter/thickness ratio: 3.0) | Amount of coated silver 0.18 |
| Gelatin | 0.77 |
| ExS-1 | $2.4\times10^{-4}$ |
| ExS-2 | $1.4\times10^{-4}$ |
| ExS-5 | $2.3\times10^{-4}$ |
| ExS-7 | $4.1\times10^{-6}$ |
| ExC-1 | $9.0\times10^{-2}$ |
| ExC-2 | $2.0\times10^{-2}$ |
| ExC-3 | $4.0\times10^{-2}$ |
| ExC-4 | $2.0\times10^{-2}$ |
| ExC-5 | $8.0\times10^{-3}$ |
| ExC-6 | $2.0\times10^{-2}$ |
| ExC-9 | $1.0\times10^{-2}$ |
| Layer 3: (Medium-speed red-sensitive emulsion layer) | |
| Silver iodobromide emulsion (AgI 6.0 mole %, inner high AgI-type having a core/shell ratio of 1:2 equivalent-sphere diameter: 0.65 μm, variation coefficient of equivalent-sphere diameter: 23%, plate-like grains, and diameter/thickness ratio: 2.0) | Amount of coated silver 0.80 |
| Gelatin | 1.46 |
| ExS-1 | $2.4\times10^{-4}$ |
| ExS-2 | $1.4\times10^{-4}$ |
| ExS-5 | $2.4\times10^{-4}$ |
| ExS-7 | $4.3\times10^{-6}$ |
| ExC-1 | 0.19 |
| ExC-2 | $1.0\times10^{-2}$ |
| ExC-3 | $2.5\times10^{-2}$ |
| ExC-4 | $1.6\times10^{-2}$ |
| ExC-5 | 0.19 |
| ExC-6 | $2.0\times10^{-2}$ |
| ExC-7 | $3.0\times10^{-2}$ |
| ExC-8 | $1.0\times10^{-2}$ |
| ExC-9 | $3.0\times10^{-2}$ |
| Layer 4: (High-speed red-sensitive emulsion layer) | |
| Silver iodobromide emulsion (AgI 9.3 mole %, multiple-structure grains having a core/shell ratio of 3:4:2, AgI contents from inner side: 24, 0, and 6 mole %, equivalent-sphere diameter: 0.75 μm, variation coefficient of equivalent-sphere diameter: 23%, plate-like grains, and diameter/thickness ratio: 2.5) | Amount of coated silver 1.05 |

-continued

| | |
|---|---|
| Gelatin | 1.38 |
| ExS-1 | $2.0 \times 10^{-4}$ |
| ExS-2 | $1.1 \times 10^{-4}$ |
| ExS-5 | $1.9 \times 10^{-4}$ |
| ExS-7 | $1.4 \times 10^{-5}$ |
| ExC-1 | $8.0 \times 10^{-2}$ |
| ExC-4 | $9.0 \times 10^{-2}$ |
| ExC-6 | $2.0 \times 10^{-2}$ |
| ExC-9 | $1.0 \times 10^{-2}$ |
| Solv-1 | 0.20 |
| Solv-2 | 0.53 |
| Layer 5: (Interlayer) | |
| Gelatin | 0.62 |
| Cpd-1 | 0.13 |
| Polyethylacrylate latex | $8.0 \times 10^{-2}$ |
| Solv-1 | $8.0 \times 10^{-2}$ |
| Layer 6: (Low-speed green-sensitive emulsion layer) | |
| Silver iodobromide emulsion (AgI 4.0 mole %, uniform AgI-type, equivalent-sphere diameter: 0.45 μm, variation coefficient of equivalent-sphere diameter: 15%, plate-like grains, and diameter/thickness ratio: 4.0) | Amount of coated silver 0.13 |
| Gelatin | 0.31 |
| ExS-3 | $1.0 \times 10^{-4}$ |
| ExS-4 | $3.1 \times 10^{-4}$ |
| ExS-5 | $6.4 \times 10^{-4}$ |
| ExM-1 | 0.12 |
| ExM-3 | $2.1 \times 10^{-2}$ |
| Solv-1 | 0.09 |
| Solv-4 | $7.0 \times 10^{-3}$ |
| Layer 7: (Medium-speed green-sensitive emulsion layer) | |
| Silver iodobromide emulsion (AgI 4.0 mole %, uniform AgI-type, equivalent-sphere diameter: 0.65 μm, variation coefficient of equivalent-sphere diameter: 18%, tabular grains, and diameter/thickness ratio: 4.0) | Amount of coated silver 0.31 |
| Gelatin | 0.54 |
| ExS-3 | $2.7 \times 10^{-4}$ |
| ExS-4 | $8.2 \times 10^{-4}$ |
| ExS-5 | $1.7 \times 10^{-4}$ |
| ExM-1 | 0.27 |
| ExM-3 | $7.2 \times 10^{-2}$ |
| ExY-1 | $5.4 \times 10^{-2}$ |
| Solv-1 | 0.23 |
| Solv-4 | $1.8 \times 10^{-2}$ |
| Layer 8: (High-speed green-sensitive emulsion layer) | |
| Silver iodobromide emulsion (AgI 9.8 mole %, multiple-structure grains having a silver content ratio of 3:4:2, AgI contents from inner side: 24, 0, and 3 mole %, equivalent-sphere diameter: 0.81 μm, variation coefficient of equivalent-sphere diameter: 23%, multiple twin plate-like grains, and diameter/thickness ratio: 2.5) | Amount of coated silver 0.49 |
| Gelatin | 0.61 |
| ExS-4 | $4.3 \times 10^{-1}$ |
| ExS-5 | $8.6 \times 10^{-5}$ |
| ExS-8 | $2.8 \times 10^{-5}$ |
| ExM-2 | $1.0 \times 10^{-2}$ |
| ExM-5 | $1.0 \times 10^{-2}$ |
| ExM-6 | $3.0 \times 10^{-2}$ |
| ExY-1 | $1.5 \times 10^{-2}$ |
| ExC-1 | $0.4 \times 10^{-2}$ |
| ExC-4 | $0.5 \times 10^{-2}$ |
| Solv-1 | 0.12 |
| Cpd-8 | $1.0 \times 10^{-2}$ |
| Layer 9: (Interlayer) | |
| Gelatin | 0.56 |
| Cpd-1 | $4.0 \times 10^{-2}$ |
| Polyethylacrylate latex | $5.0 \times 10^{-2}$ |
| Solv-1 | $3.0 \times 10^{-2}$ |
| UV-4 | $3.0 \times 10^{-2}$ |
| UV-5 | $4.0 \times 10^{-2}$ |
| Layer 10: (Donor layer of an interlayer effect to red-sensitive layer) | |
| Emulsion A-2 | Amount of coated silver 0.67 |
| Silver iodobromide emulsion (AgI 10.0 mole %, inner high AgI-type grains having a core/shell ratio of 1:3, equivalent-sphere diameter: 0.40 μm, variation coefficient of equivalent-sphere diameter: 15%, regular crystal grains) | Amount of coated silver 0.20 |
| Gelatin | 0.87 |
| ExS-3 | $5.8 \times 10^{-4}$ |
| ExM-1 | 0.17 |
| Solv-1 | 0.30 |
| Solv-6 | $3.0 \times 10^{-2}$ |
| Layer 11: (Yellow Filter Layer) | |
| Yellow colloidal silver | $9.0 \times 10^{-2}$ |
| Gelatin | 0.84 |
| Cpd-2 | 0.13 |
| Solv-1 | 0.13 |
| Cpd-1 | $5.0 \times 10^{-2}$ |
| Cpd-6 | $2.0 \times 10^{-3}$ |
| H-1 | 0.25 |
| Layer 12: (Low-speed blue-sensitive emulsion layer) | |
| Silver iodobromide emulsion (AgI 9.0 mole %, multiple-structure grains, equivalent-sphere diameter: 0.70 μm, variation coefficient of equivalent-sphere diameter: 20%, tabular grains, diameter/thickness ratio: 7.0, grains observed via 200 KV transmission electron microscope to have 10 or more dislocation lines therein occupy 50% or more of all grains) | Amount of coated silver 0.50 |
| Silver iodobromide emulsion (AgI 2.5 mole %, uniform AgI-type, equivalent-sphere diameter: 0.50 μm, variation coefficient of equivalent-sphere diameter: 30%, tabular grains, and diameter/thickness ratio: 6.0) | Amount of coated silver 0.30 |
| Gelatin | 2.18 |
| ExS-6 | $9.0 \times 10^{-4}$ |
| ExC-1 | 0.03 |
| ExC-2 | 0.08 |
| ExY-2 | 0.05 |
| ExY-5 | 1.09 |
| Solv-1 | 0.54 |
| Layer 13: (Interlayer) | |
| Gelatin | 0.30 |
| ExY-4 | 0.14 |
| Solv-1 | 0.14 |
| Layer 14: (High-speed blue-sensitive emulsion layer) | |
| Silver iodobromide emulsion (AgI 10.0 mole %, inner high AgI-type grain, equivalent-sphere diameter: 1.2 μm, variation coefficient of equivalent-sphere diameter: 25%, multiple twin plate-like grain, and diameter/thickness ratio: 2.0) | Amount of coated silver 0.40 |
| Gelatin | 0.59 |
| ExS-6 | $2.6 \times 10^{-4}$ |
| ExM-5 | 0.20 |
| ExC-1 | $1.0 \times 10^{-2}$ |
| Solv-1 | $9.0 \times 10^{-2}$ |
| Layer 15: (First protective layer) | |
| Fine-grain silver iodobromide emulsion (AgI 2.0 mole %, uniform AgI-type, equivalent-sphere diameter: 0.07 μm) | Amount of coated silver 0.12 |
| Gelatin | 0.63 |
| UV-4 | 0.11 |
| UV-5 | 0.18 |
| Solv-5 | $2.0 \times 10^{-2}$ |
| Cpd-5 | 0.10 |
| Polyethylacrylate latex | $9.0 \times 10^{-2}$ |
| Layer 16: (Second protective layer) | |
| Fine-grain silver iodobromide emulsion (AgI 2.0 mole %, uniform AgI-type, equivalent-sphere diameter: 0.07 μm) | Amount of coated silver 0.36 |
| Gelatin | 0.85 |
| B-1 (diameter: 2.0 μm) | $8.0 \times 10^{-2}$ |
| B-2 (diameter: 2.0 μm) | $8.0 \times 10^{-2}$ |
| B-3 | $2.0 \times 10^{-2}$ |
| W-4 | $2.0 \times 10^{-2}$ |
| H-1 | 0.18 |

In the sample thus prepared, further added were 1,2-benzisothiazolin-3-one (average of 200 ppm with respect to gelatin), n-butyl-p-hydroxybenzoate (about 1000 ppm with respect to gelatin), and 2-phenoxyethanol (about 10000 ppm with respect to gelatin). The sample also contained B-4, B-5, B-6, F-1, F-2, F-3, F-4, F-5, F-6, F-7, F-8, F-9, F-10, F-11, F-12, an iron salt, a lead salt, a gold salt, a platinum salt, an iridium salt, and a rhodium salt.

In addition to the above substances, surface active agens W-1, W-2, and W-3 were added to all the layers, as a coating aid and an emulsifying dispersion agent.

UV-1

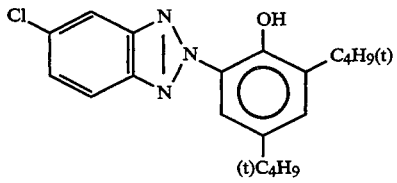

UV-2

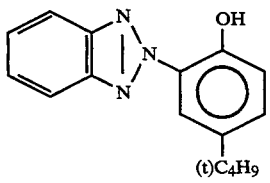

UV-3

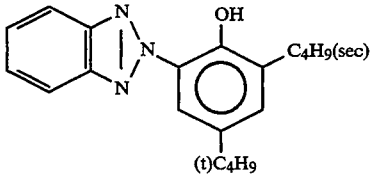

UV-4

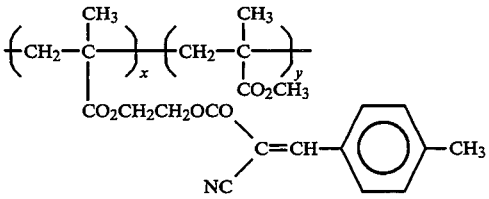

x:y = 70:30 (wt %)

UV-5

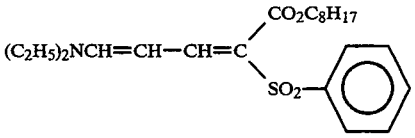

Solv-1

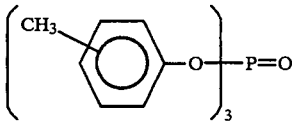

Solv-2

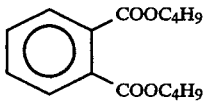

Solv-4

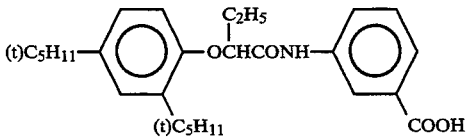

Solv-5

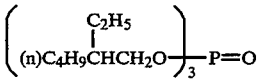

Solv-6

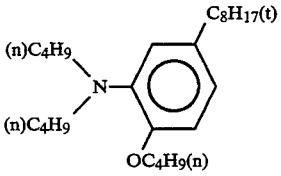

ExF-1

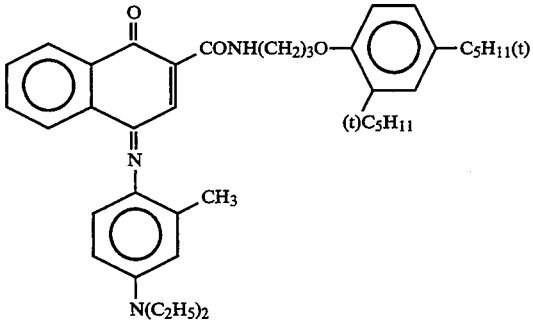

-continued
ExF-2
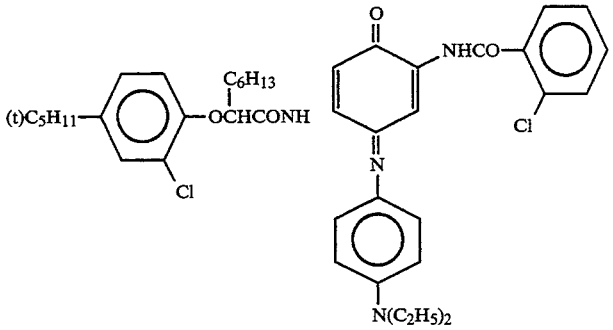
ExF-3
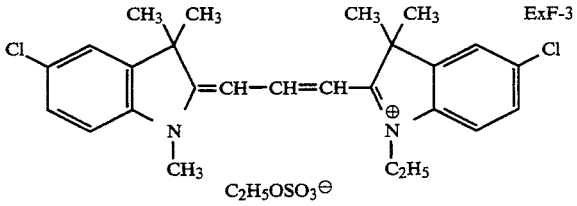
ExC-1
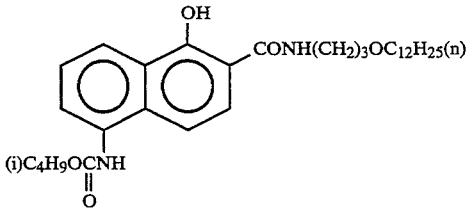
ExC-2
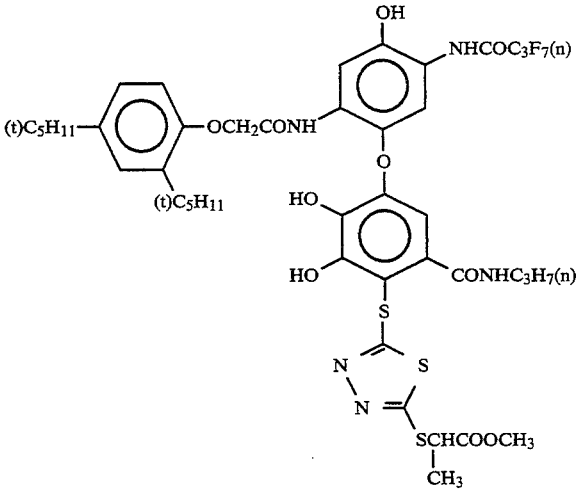
ExC-3
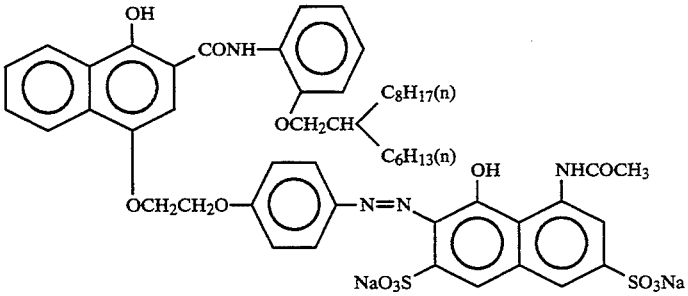
ExC-4
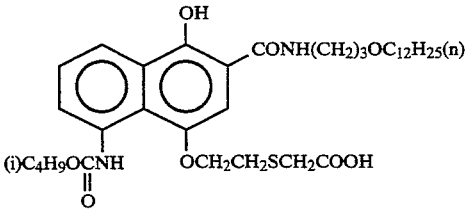

-continued
ExC-5
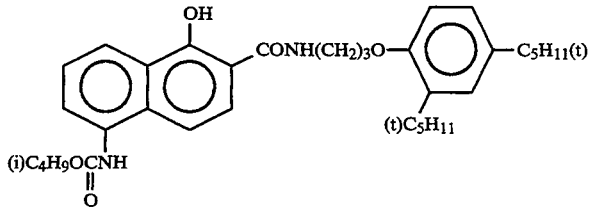
ExC-6
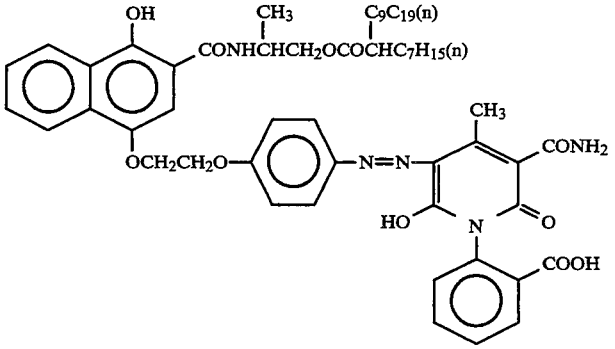
ExC-7
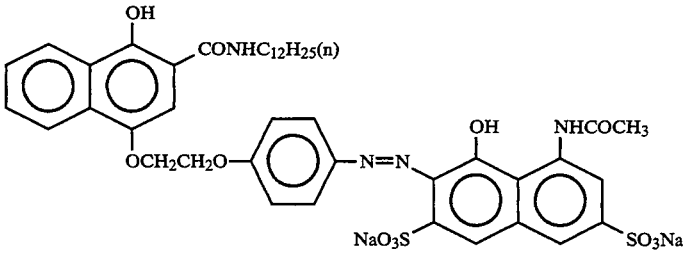
ExC-8
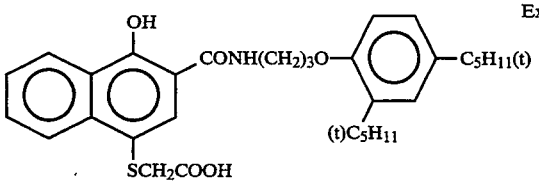
ExC-9
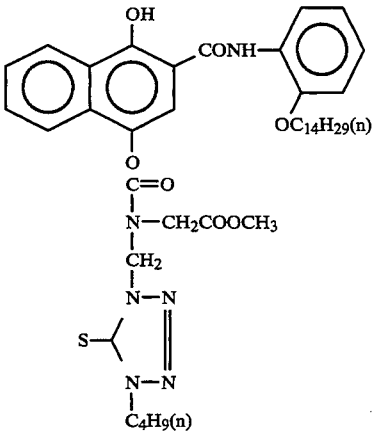
ExM-1
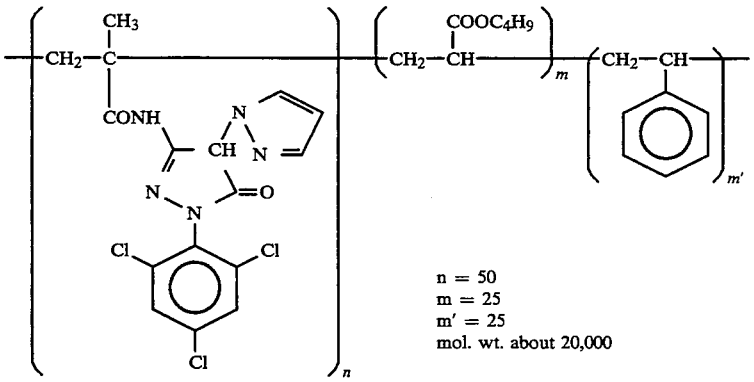
n = 50
m = 25
m' = 25
mol. wt. about 20,000

-continued
ExM-2
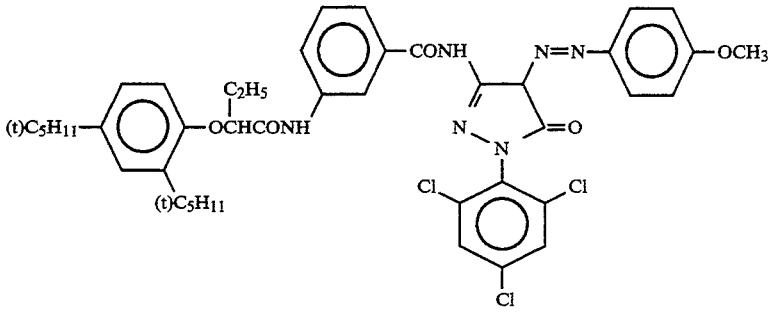
ExM-3
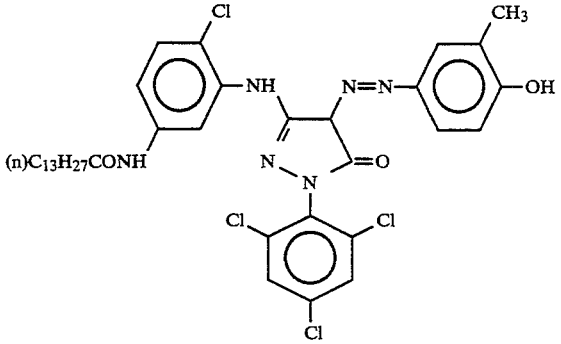
ExM-5
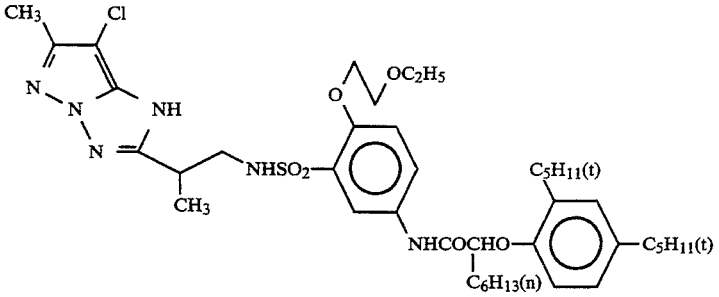
ExM-6
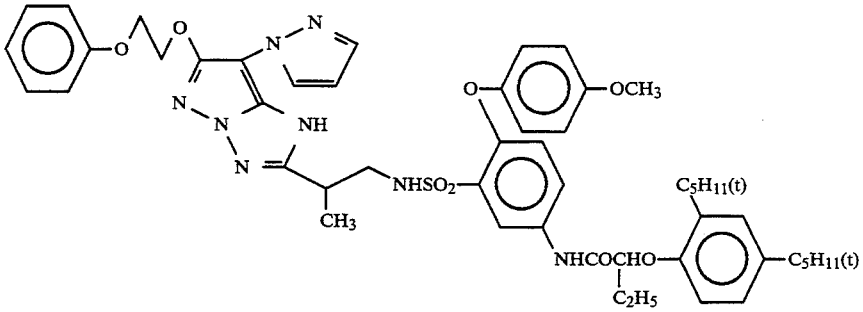
ExY-1
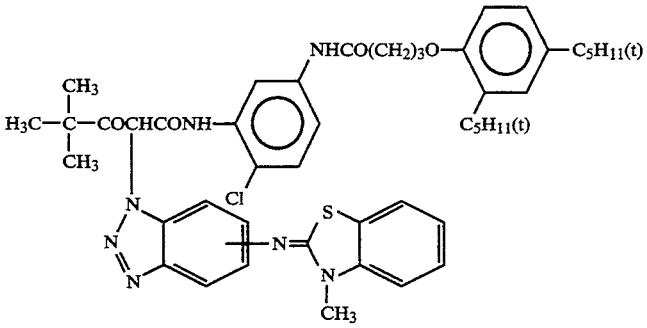

-continued
ExY-2
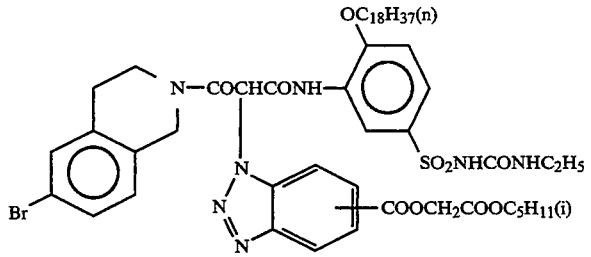
ExY-4
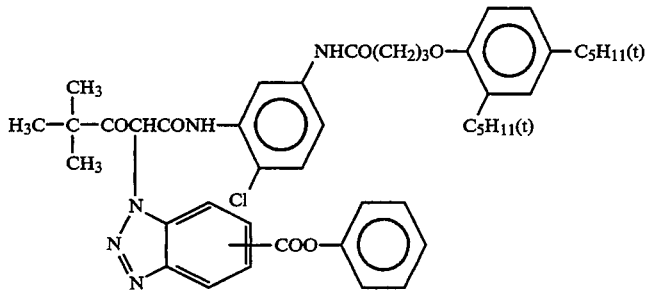
ExY-5
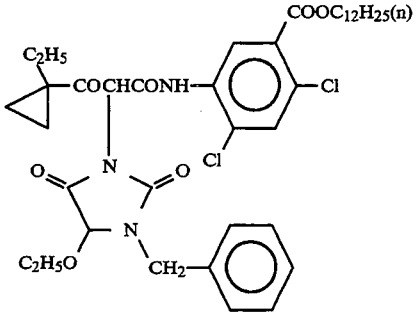
Cpd-1
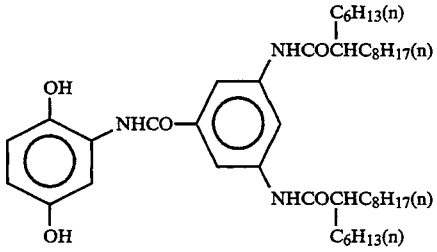
Cpd-2
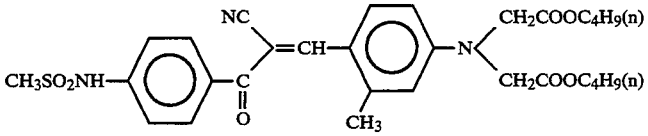
Cpd-5
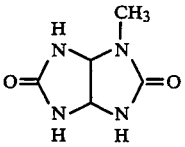
Cpd-6
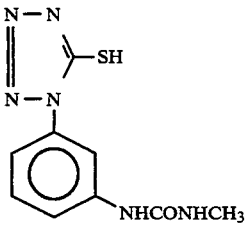
Cpd-8
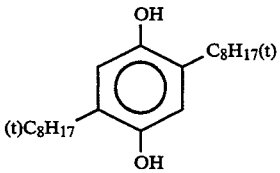
H-1
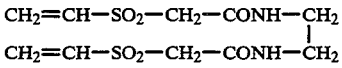
W-1
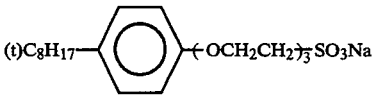
W-2
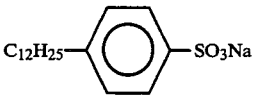

-continued
W-3
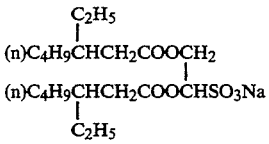
W-4
$C_8F_{17}SO_2N(C_3H_7)CH_2COOK$
WxS-1
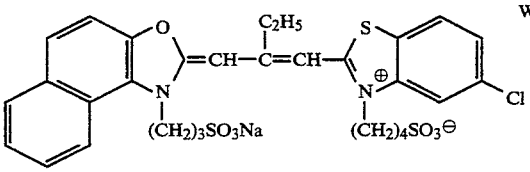
ExS-2
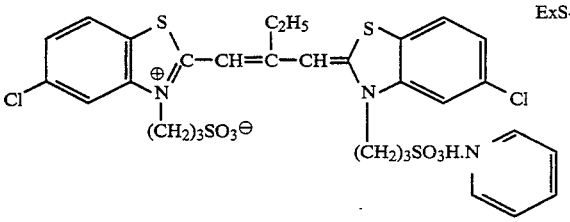
ExS-3
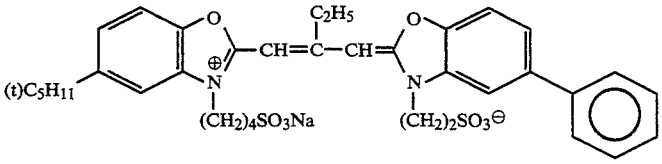
ExS-4
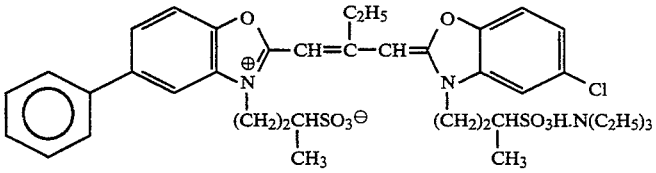
ExS-5
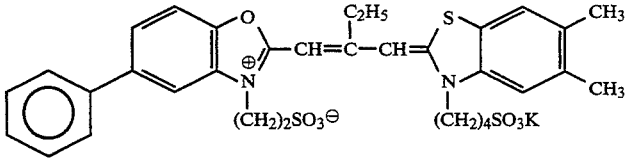
ExS-6
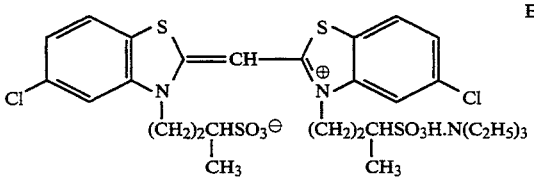
ExS-7
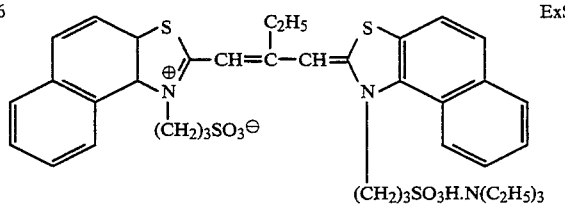
ExS-8
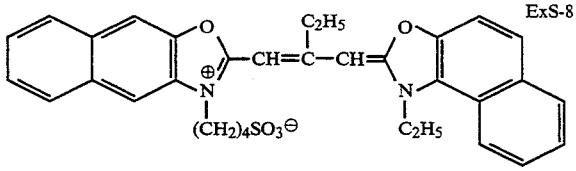
F-1
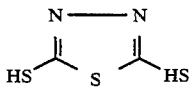
F-2
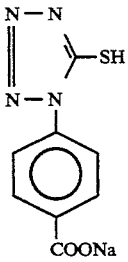
F-3
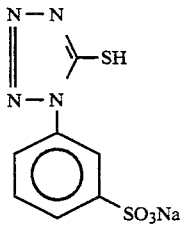

-continued

F-4

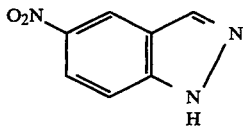

F-5

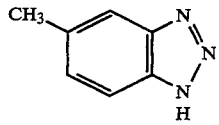

F-6

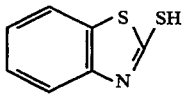

F-7

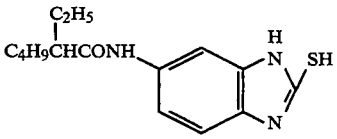

F-8

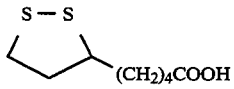

F-9

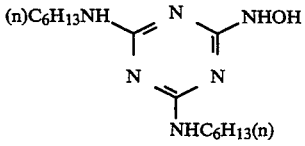

F-10

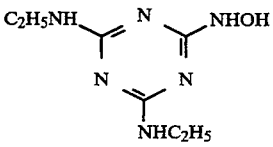

F-11

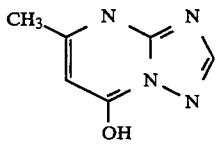

F-12

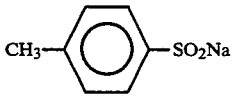

B-1

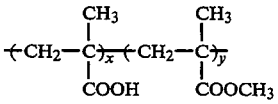

x/y = 10/90

B-2

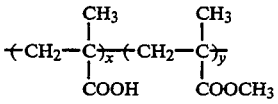

x/y = 40/60

B-3

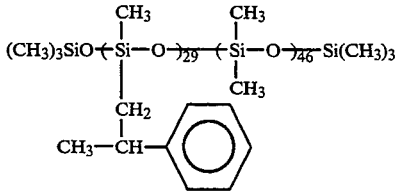

B-4

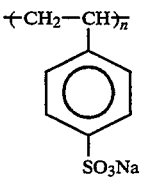

B-5

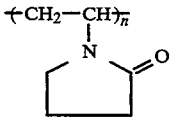

(mol. wt. about 10,000)

B-6

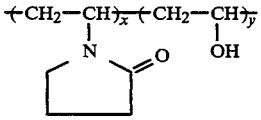

x/y = 70/30

(Preparation of Sample 102)

Sample 102 was prepared in the same manner as that of the sample 101 except that the emulsion A-2 of the layer 10 was replaced with the emulsion C-2.

(Preparation of Samples 103 and 104)

Samples 103 and 104 were prepared in the same manner as that of sample 101 except that the magenta coupler ExM-1 in the layer 10 was replaced with a mixture of 80 mole % of ExM-1 and 20 mole % of D-19 of the invention in both samples, and emulsions A-2 and C-2 were used in samples 103 and 104, respectively. (The amount of the couplers used in the layer 10 was set to be the same as that of the sample 101 in mole in both samples.)

(Preparation of Samples 105 and 106)

Samples 105 and 106 were prepared in the same manner as those of samples 103 and 104 except that the ratio of ExM-1/D-19 was changed from 80 mole %/20 mole % to 60 mole %/40 mole % in both samples, and emulsions A-2 and C-2 were used in samples 105 and 106, respectively.

(Preparation of Samples 107 and 108)

Samples 107 and 108 were prepared in the same manner as those of samples 103 and 104 except that the ratio of ExM-1/D-19 was changed to 40 mole %/60 mole % in both samples, and emulsions A-2 and C-2 were used in samples 107 and 108, respectively.

(Preparation of Samples 109 and 110)

Samples 109 and 110 were prepared in the same manner as those of samples 103 and 104 except that the ratio of ExM-1/D-19 was changed to 20 mole %/80 mole % in both samples, and emulsions A-2 and C-2 were used in samples 109 and 110, respectively.

(Preparation of Sample 111)

Sample 111 was prepared in the same manner as that of sample 109 except that the amount of emulsion A-2 applied was increased from 0.67 g/m$^2$ (the amount of coated silver) to 1.07 g/m$^2$.

(3) Evaluation

The samples 101 to 111 were allowed to stand at a temperature 40° C. and a relative humidity of 70% for 14 hours, and then exposed to light under two types of Exposure Conditions I and II listed below. Then using an automatic developing machine, the samples were processed under Processing Condition below.

Exposure Condition I (White Exposure)

Each sample was exposed to white light for 1/100 sec through a 4800° K. color-temperature conversion filter and a continuous wedge.

Exposure Condition II (Red Exposure)

Each sample was exposed to light for 1/100 sec through a 4800° K. color-temperature conversion filter, SC-62 Fuji Filter (red filter) transmitting the light having a wavelength longer than 620 nm, and a continuous wedge.

Processing Condition

| Steps | Time | Temp. | Replenishment Amount* | Tank Vol. |
|---|---|---|---|---|
| Color development | 3 min 15 sec | 38° C. | 33 ml | 20L |
| Bleaching | 6 min 30 sec | 38° C. | 25 ml | 40L |
| Water washing | 2 min 10 sec | 24° C. | 1200 ml | 20L |
| Fixing | 4 min 20 sec | 38° C. | 25 ml | 30L |
| Water washing (1) | 1 min 05 sec | 24° C. | Counter flow piping from (2) to (1) | 10L |
| water washing (2) | 1 min 00 sec | 24° C. | 1200 ml | 10L |
| Stabilization | 1 min 05 sec | 38° C. | 25 ml | 10L |
| Drying | 4 min 20 sec | 55° C. | | |

*Replenishment amount: per meter of the 35 mm wide light-sensitive material

The compositions of the processing solutions were as follows:

| (Color Developing Solution) | Mother Solution (g) | Replenisher (g) |
|---|---|---|
| Diethylenetriamine-pentaacetic acid | 2.0 | 1.1 |
| 1-hydroxyethylidene-1, 1-diphsophonic acid | 3.3 | 3.2 |
| Sodium sulfite | 4.0 | 4.4 |
| Potassium carbonate | 30.0 | 37.0 |
| Potassium bromide | 1.4 | 0.7 |
| Potassium iodide | 1.5 mg | — |
| Hydroxylamine sulfate | 2.4 | 2.8 |
| 4-[N-ethyl-N-β-hydroxyethylamino]-2-methylaniline sulfate | 4.5 | 5.5 |
| water to make | 1.0 liter | 1.0 liter |
| pH | 10.5 | 10.10 |
| (Bleaching Solution) | | |
| Ferrous ethylenediamine-tetraacetate | 100.0 | 120.0 |
| Disodium ethylenediamine-tetraacetate | 10.0 | 11.0 |
| Ammonium bromide | 140.0 | 160.0 |
| Ammonium nitrate | 30.0 | 35.0 |
| Ammonia water (27%) | 6.5 ml | 4.0 ml |
| water to make | 1.0 liter | 1.0 liter |
| pH | 6.0 | 5.7 |
| (Fixing Solution) | | |

-continued

| | | |
|---|---|---|
| Disodium ethylenediamine-tetraacetate | 0.5 | 0.7 |
| Sodium sulfite | 7.0 | 8.0 |
| Sodium bisulfite | 5.0 | 5.5 |
| Aqueous solution of Ammonium thiosulfate (70%) | 170.0 ml | 200.0 ml |
| water to make | 1.0 liter | 1.0 liter |
| pH | 6.7 | 6.6 |
| (Stabilizing Solution) | | |
| Formalin (37%) | 2.0 ml | 3.0 ml |
| Polyoxyethylene-p-monononylphenyl ether (average polymerization degree: 10) | 0.3 | 0.45 |
| Disodium ethylenediamine-tetraacetate | 0.05 | 0.08 |
| Water to make | 1.0 liter | 1.0 liter |
| pH | 5.0 to 8.0 | 5.0 to 8.0 |

Of the processed samples, those exposed under the Exposure Condition I (white exposure) were measured for a transmission density through a green filter, and a sensitivity (green sensitivity) and a contrast (green contrast) were obtained.

The green sensitivity was expressed in the relative value of a reciprocal of the exposure amount (lux.sec) required to give a density of fog+0.2.

The green contrast was expressed in the relative value obtained by doubling the difference obtained by subtracting the logarithm of the exposure amount required to give a density of fog+0.2 from the logarithm of the exposure amount required to give a density of fog+0.7.

In order to determine changes in properties when the DIR coupler D-19 of the invention, which releases a diffusing development inhibitor, was used, rates of changes in green sensitivity and green contrast for the samples using the mixture of ExM-1 and D-19 were calculated with respect to the samples using only ExM-1 (Samples 101 and 102).

In order to evaluate the degree of interlayer effect received in a red-sensitive layer, the samples exposed under the Exposure Condition I (white exposure) and processed, and the samples exposed under the Exposure Condition II (red exposure) and processed, were measured for a transmission density through a red filter, and contrasts (red contrast) were obtained. Then, the ratio of the red contrast when exposed by red exposure to that when exposed by white exposure. The larger the ratio, the higher the saturation of red when gray is reproduced on a color print.

Unlike the green contrast, the red contrast was expressed by the relative value obtained by subtracting the logarithm of the exposure amount required to give a density of fog+1.2 from the logarithm of the exposure amount required to give a density of fog+0.2.

In order to evaluate the sharpness of the red-sensitive layer of each of the samples 109, 110, and 111, the MTF value of each sample was measured by the conventional MTF measuring method. Each sample was exposed to white light for 1/100 second through a 4800° K. color-temperature conversion filter and a wedge for measuring a resolution, and subjected to the above-described color development process. Then, by use of a cyclocolor densitometer, the MTF value of a cyan image at 25 cycle/mm was obtained. The MTF value was indicated by a relative value, with that of sample 111 used as a reference value of 100.

The contents of the samples 101 to 111, and the results of the measurements were as specified in Tables 6 and 7 below.

As can be seen from Tables 6 and 7, the samples of the present invention had a significant interlayer effect to a red-sensitive layer, and a high green sensitivity and contrast.

Further, it is also seen that the sample 111, in which the amount of emulsion A-2 (comparative emulsion) was increased so as to make the interlayer effect to a red-sensitive layer, and the green sensitivity and contrast, close to those of the sample 110 of the invention, had a poor sharpness in the underlayer (red-sensitive layer).

TABLE 6

| Sample contents | | | | | | Photographic performance | | | |
|---|---|---|---|---|---|---|---|---|---|
| | Mixed ratio of couplers in layer 10 (mole %) | | Emulsion of layer 10 | | | Exposure condition I (white exposure) | | Rate of change with respect to 100 mole % of ExM-1 | |
| Sample No. | ExM-1 | compound D-19 | Emulsion No. | Dis-cation lines | Coated amount (silver g/m$^2$) | Green sensitivity*1 | Green contrast*2 | Rate of change of green sensitivity | Rate of change of green contrast |
| 101 (comparative example) | 100 mole % | 0 mole % | A-2 | ca. 0 | 0.67 g/m$^2$ | 100 | 1.00 | | |
| 102 (comparative example) | 100 mole % | " | C-2 | 20 or more | " | 100 | 1.00 | | |
| 103 (comparative example) | 80 | 20 | A-2 | ca. 0 | " | 93 | 0.98 | 0.93 | 0.98 |
| 104 (comparative example) | " | " | C-2 | 20 or more | " | 98 | 0.99 | 0.98 | 0.99 |
| 105 (comparative example) | 60 | 40 | A-2 | ca. 0 | 0.67 g/m$^2$ | 87 | 0.94 | 0.87 | 0.94 |
| 106 (present invention) | " | " | C-2 | 20 or more | " | 95 | 0.98 | 0.95 | 0.98 |
| 107 (comparative example) | 40 | 60 | A-2 | ca. 0 | " | 83 | 0.92 | 0.83 | 0.92 |
| 108 (present invention) | " | " | C-2 | 20 or more | " | 93 | 0.979 | 0.93 | 0.97 |
| 109 (comparative example) | 20 | 80 | A-2 | ca. 0 | 0.67 g/m$^2$ | 79 | 0.90 | 0.79 | 0.90 |
| 110 (present invention) | " | " | C-2 | 20 or more | " | 91 | 0.96 | 0.91 | 0.96 |
| 111 (comparative example) | " | " | A-2 | ca. 0 | 1.07 | 90 | 0.96 | 0.90 | 0.96 |

*1 Expressed by relative value with reference to 100 of green sensitivity of sample 101
*2 Expressed by relative value with reference to 1.00 of green contrast of sample 101
*3 Expressed by relative value with reference to 1.00 of red contast when sample 101 was exposed under exposure conditions II (red exposure)
*4 Relative value of MIF value of 25 cycle/m cyan image. Expressed by relative value to 100 of MIF value of sample 111

TABLE 7

| | Interlayer effect on red-sensitive layer | | | Sharpness |
|---|---|---|---|---|
| | Red contrast*3 | | Ratio of red contrast | (red-sensitive layer) |
| Sample No. | Exposure condition I (white exposure) | Exposure condition II (red exposure) | (red exposure) to red contrast (white exposure) | MTF value (cyan) |
| 101 (comparative example) | 0.82 | 1.00 | 1.22 | |
| 102 (comparative example) | 0.82 | 1.00 | 1.22 | |
| 103 (comparative example) | 0.78 | 1.01 | 1.28 | |
| 104 (comparative example) | 0.75 | 1.00 | 1.33 | |
| 105 (comparative example) | 0.74 | 1.00 | 1.35 | |
| 106 (Present | 0.66 | 1.00 | 1.52 | |

TABLE 7-continued

| Sample No. | Interlayer effect on red-sensitive layer: Red contrast*3 — Exposure condition I (white exposure) | Red contrast*3 — Exposure condition II (red exposure) | Ratio of red contrast (red exposure) to red contrast (white exposure) | Sharpness (red-sensitive layer) MTF value (cyan) |
|---|---|---|---|---|
| invention) | | | | |
| 107 (comparative example) | 0.72 | 1.00 | 1.39 | |
| 108 (present invention) | 0.63 | 1.01 | 1.60 | |
| 109 (comparative example) | 0.70 | 1.00 | 1.43 | 126 |
| 110 (present invention) | 0.60 | 1.00 | 1.67 | 140 |
| 111 (comparative example) | 0.60 | 0.99 | 1.65 | 100 |

In order to evaluate the color reproducibility, the samples 105, 106 and 107 were processed into Leica size, and a photograph of the color rendition chart available from Macbeth co. was taken at the light having a color temperature of 5500° K., and the above-described color development was conducted.

The processed film was printed on a Fuji Color FA paper such that the gray color having a reflectivity of 18%) photographed at the same time, matches with the original, and the sharpness of red was evaluated. According to the result, the sample 106 had a very high saturation of red as compared to the samples 105 and 107.

What is claimed is:

1. A silver halide color photographic light-sensitive material comprising at least one light-sensitive silver halide emulsion layer on a support, wherein at least one light-sensitive silver halide emulsion layer contains tabular grains having an aspect ratio of 5 or more and 10 or more dislocation lines per grain, in an amount of 30% or more of a total projected area of all grains in the layer, and at least 30 mole % of all couplers contained in the layer is occupied by a DIR coupler which releases a diffusing development inhibitor or a precursor thereof upon reaction with an oxidized form of a developing agent, or cleaves to form another compound upon reaction with an oxidized form of a developing agent, which cleaved compound in turn reacts with another molecule of oxidized form of a developing agent to release a development inhibitor.

2. The light-sensitive material according to claim 1, wherein said tabular grains having 10 or more dislocation lines occupy 50 mol % or more of all the grains.

3. The light-sensitive material according to claim 1, wherein said DIR coupler is represented by the following Formulas (I), (II), or (III):

Formula (I) A-DI

Formula II A-$(TIME)_a$-DI

Formula III A-$(TIME)_i$-RED-DI where A represents a coupler moiety which undergoes a coupling reaction with the oxidized form of an aromatic primary amine developing agent to split off DI, $(TIME)_a$-DI, or $(TIME)_i$-RED-DI; TIME represents a timing group which cleaves DI or RED-DI after splitting off from A or TIME upon the coupling reaction; RED represents a group which reacts with the oxidized form of a developing agent after splitting off from A or TIME to cleave DI bonded to it; DI represents a development inhibitor; a represents 1 or 2; i represents 0 or 1; and if a represents 2, two TIMEs may be the same or different.

4. The light-sensitive material according to claim 3, wherein said DI is represented by the following formula DI-1, DI-2, DI-3, DI-4, DI-5 or DI-6:

DI-1

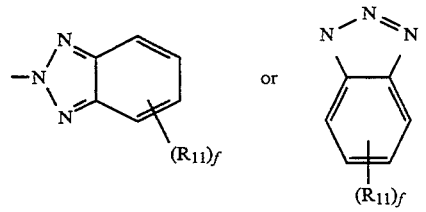

DI-2

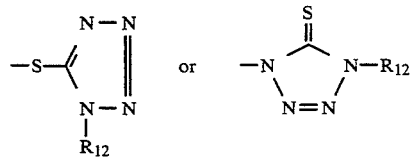

DI-3

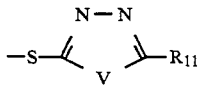

DI-4

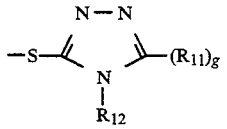

DI-5

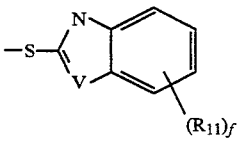

DI-6

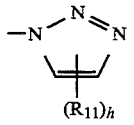

where $R_{11}$ represents a halogen atom, an alkoxycarbonyl group, an acylamino group, a carbamoyl group, a sulfamoyl group, an alkoxy group, an aryloxy group, an aryloxycarbonyl group, an alkoxycarbonylamino group, a cyano group, a nitro group, an alkylthio group, a ureido group, an aryl group, a heterocyclic group, an alkyl group, an acyl group, an arylthio group, or an aryloxycarbonylamino group; $R_{12}$ represents an aryl group, a heterocyclic group, or an alkyl group; V represents an oxygen atom or a sulfur atom; f represents 1 to 4, g represents 0 or 1; and h represents 1 or 2.

5. The light-sensitive material according to claim 3, wherein said TIME is represented by the following Formula (T-1), (T-2), or (T-3):

Formula (T-1) *-W-(X=Y)$_j$-C($R_{21}$)$R_{22}$-**

Formula (T-2) *-W-CO-**

Formula (T-3) *-W-LINK-E-** where mark * represents a position where TIME bonds with A in Formula (II); mark ** represents a position where TIME bonds with DI, or TIME (if a represents the plural number); W represents an oxygen atom, a sulfur atom, or >N-$R_{23}$; each of X and Y represents a methine group or a nitrogen atom; j represents 0, 1, or 2; each of $R_{21}$, $R_{22}$, and $R_{23}$ represents a hydrogen atom or a substituent; any two substituents selected from the substituents of a methine group represented by X and Y, and the substituents represented by $R_{21}$, $R_{22}$ and $R_{23}$ may bond together to form a cyclic structure; and in Formula (T-3), E represents an electrophilic group, and LINK represents a linking group which sterically links W to E so that they can undergo an intramolecular nucleophilic substitution reaction.

6. The light-sensitive material according to claim 3, wherein said RED is selected from hydroquinones, 1,4-naphthohydroquinones, 2-(or 4-)sulfonamidophenols, pyrogallols, and hydrazides in which a redox group having a phenolic hydroxyl group combines with A at the oxygen atom of the phenol group.

7. The light-sensitive material according to claim 1, wherein at least 50 mole % of all couplers contained in the layer is occupied by said DIR coupler.

8. The light-sensitive material according to claim 1, wherein the grain diameter of the tabular grain is in the range of 0.3 to 5.0 μm and the grain thickness of the tabular grain is 0.05 to 1.0 μm.

9. The light-sensitive material according to claim 1, wherein said tabular grains have 20 or more dislocation lines per grain.

10. The light-sensitive material according to claim 5, wherein TIME represented by formula (T-1) is selected from the group consisting of

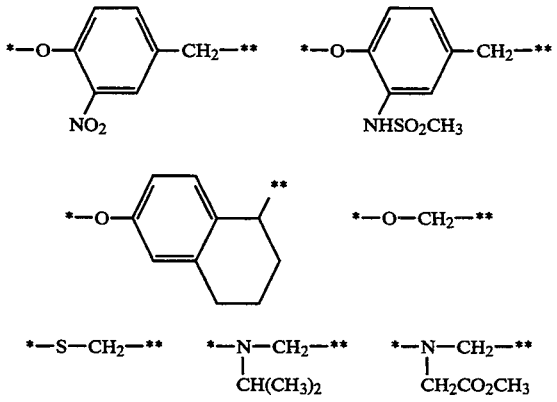

-continued

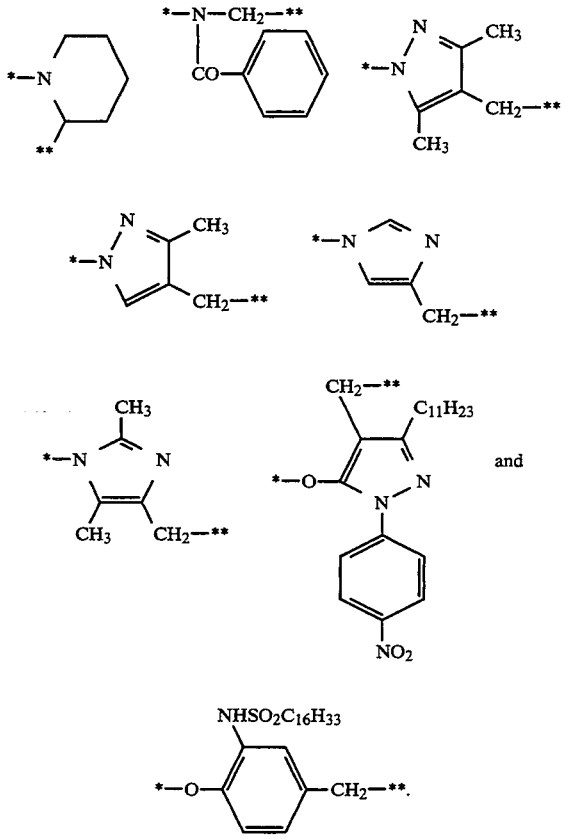

11. The light-sensitive material according to claim 5, wherein TIME represented by formula (T-2) is selected from the group consisting of

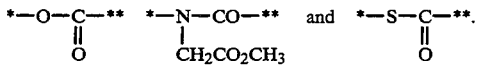

12. The light-sensitive material according to claim 5, wherein TIME represented by formula (T-3) is selected from the group consisting of

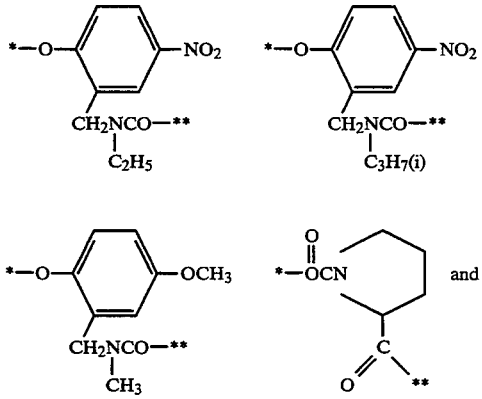

-continued

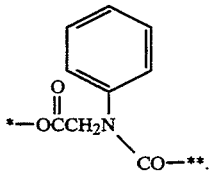

13. The light-sensitive material according to claim 3, wherein $(TIME)_a$ when a represents 2 or more in Formula (II) is selected from the group consisting of

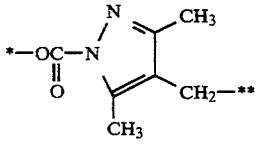

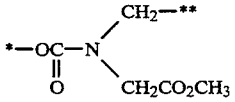

-continued

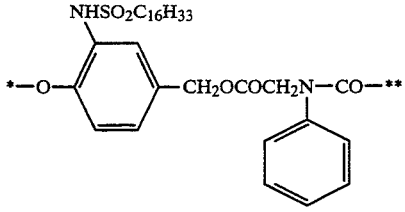

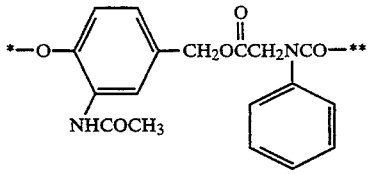

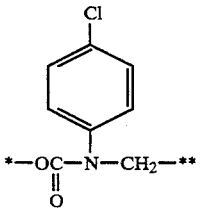

and

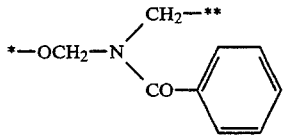

14. The light-sensitive material according to claim 3, wherein said RED is selected from the group consisting of hydroquinones, catechols, pyrogallols, 1,4-naphthohydroquinones, 1,2-naphthohydroquinones, sulfonamidophenols, hydrazides, and sulfonamidonaphthols.

* * * * *